US006017229A

United States Patent [19]

Tulley et al.

[11] Patent Number: 6,017,229

[45] **Date of Patent: *Jan. 25, 2000**

[54] MODULAR OUTLET EMPLOYING A DOOR ASSEMBLY

[75] Inventors: Brian Tulley, Ansonia; Denny Lo, Danbury; John A. Siemon, Woodbury; Art Bauer, Ivoryton, all of Conn.

[73] Assignee: The Siemon Company, Watertown, Conn.

[ * ] Notice: This patent is subject to a terminal disclaimer.

[21] Appl. No.: 09/098,673

[22] Filed: Jun. 17, 1998

Related U.S. Application Data

[63] Continuation of application No. 08/652,230, May 23, 1996, Pat. No. 5,769,647, which is a continuation-in-part of application No. 08/562,373, Nov. 22, 1995, Pat. No. 5,791,943.

[51] Int. Cl.[7] ..... H01R 13/44

[52] U.S. Cl. ..... 439/144; 439/491

[58] Field of Search ..... 439/144, 676, 439/135–142, 147, 149, 491, 535, 536

[56] References Cited

U.S. PATENT DOCUMENTS

| | | | |
|---|---|---|---|
| 1,432,793 | 4/1922 | Gandrud . | |
| 1,440,392 | 6/1923 | Balde . | |
| 3,189,212 | 6/1965 | Bellek | 439/142 |
| 3,757,028 | 9/1973 | Schlessel . | |
| 4,367,908 | 1/1983 | Johnson . | |
| 4,413,469 | 11/1983 | Paquin . | |
| 4,418,239 | 11/1983 | Larson et al. . | |
| 4,550,964 | 11/1985 | Donais et al. . | |
| 4,707,564 | 11/1987 | Gonzales | 439/142 |
| 4,732,565 | 3/1988 | Ito et al. . | |
| 4,784,610 | 11/1988 | Stuart | 439/144 |
| 4,831,497 | 5/1989 | Webster et al. . | |
| 4,850,887 | 7/1989 | Sugawara . | |
| 5,124,506 | 6/1992 | Briggs et al. | 439/142 |
| 5,186,647 | 2/1993 | Denkmann et al. | 439/676 |
| 5,211,566 | 5/1993 | Bates et al. | 439/138 |
| 5,211,583 | 5/1993 | Endo et al. . | |
| 5,217,190 | 6/1993 | Reed et al. | 439/491 |
| 5,299,956 | 4/1994 | Brownell et al. . | |
| 5,362,254 | 11/1994 | Siemon et al. | 439/142 |
| 5,385,479 | 1/1995 | Okada . | |
| 5,412,751 | 5/1995 | Siemon et al. . | |

(List continued on next page.)

FOREIGN PATENT DOCUMENTS

| | | | |
|---|---|---|---|
| 0352347 | 1/1990 | European Pat. Off. | 439/491 |
| 0 525 703 A1 | 3/1993 | European Pat. Off. . | |
| 61-256850 | 11/1986 | Japan . | |
| 2 233 157 | 1/1991 | United Kingdom . | |

OTHER PUBLICATIONS

Bill Howell and Charles Brischler, Improved RJ45: A *stronger link in the Category 5 LAN chain,* EDS '94 Show Daily Newspaper No Month.

The Siemon Company, *Modular Wiring Reference* US Army Document published 1956; pp. 3–19–3–16.

Siemens Publication from United Kingdom, pp. 134–147 Published by the Post Master General Department in Australia in 1951; pp. 1–16 No Month.

*Primary Examiner*—Steven L. Stephan
*Assistant Examiner*—J. F. Duverne
*Attorney, Agent, or Firm*—Cantor Colburn LLP

[57] ABSTRACT

An outlet door assembly that is retainable in both an open and a closed position is presented. In accordance with the present invention, the door comprises a pair of mounting arms having inwardly extending protrusions which are received in notches for retaining the door in the closed and open position. In one embodiment the connector housing has an outwardly extending protrusion within each of a pair of notches to define the positions for retaining the protrusions on the door arms. In another embodiment a door holder is employed which has pairs of notches, with one pair of notches receiving the protrusions of the door arms therein for retaining the door in a closed position and another pair of notches receiving the protrusions of the door arms therein for retaining the door in an open position. In both embodiments the door includes a channel for receiving an identification icon therein.

14 Claims, 36 Drawing Sheets

OTHER PUBLICATIONS 5,474,474 12/1995 Siemon et al. ..... 439/676
5,487,683 1/1996 Carlson, Jr. ..... 439/491
5,525,078 6/1996 Springer .
5,547,405 8/1996 Pinney et al. .
5,574,625 11/1996 Ohgami et al. .

MODULAR OUTLET EMPLOYING A DOOR ASSEMBLY

CROSS-REFERENCE TO RELATED APPLICATIONS

This is a continuation of U.S. patent application Ser. No. 08/652,230 entitled MODULAR OUTLET EMPLOYING A DOOR ASSEMBLY filed May 23, 1996, now U.S. Pat. No. 5,769,647, which is incorporated herein by reference in its entirety, which is a continuation-in-part of U.S. patent application Ser. No. 08/562,373 entitled REDUCED CROSSTALK MODULAR OUTLET filed Nov. 22, 1995, now U.S. Pat. No. 5,791,943, which is incorporated herein by reference in its entirety.

BACKGROUND OF THE INVENTION

The present invention relates to connectors. More particularly, the present invention relates to a connector assembly employing a novel door assembly.

Communication system and/or network efficiency is directly dependent upon the integrity of the connector scheme employed. Such connector schemes include, for example, standard interfaces for equipment/user access (outlet connector), transmission means (horizontal and backbone cabling), and administration/distribution points (cross-connect and patching facilities). Regardless of the type or capabilities of the transmission media used for an installation, the integrity of the cabling infrastructure is only as good as the performance of the individual components that bind it together.

By way of example, a non-standard connector or pair scheme may require that work area outlets be rewired to accommodate a group move, system change, or an installation with connecting hardware whose installed transmission characteristics are compatible with an existing application but are later found to have inadequate performance when the system is expanded or upgraded to higher transmission rates. Accordingly, connecting hardware without properly qualified design and transmission capabilities, can drain user productivity, compromise system performance and pose a significant barrier to new and emerging applications.

Reliability, connection integrity and durability are also important considerations, since cabling life cycles typically span periods of ten to twenty years. In order to properly address specifications for, and performance of telecommunications connecting hardware, it is preferred to establish a meaningful and accessible point of reference. The primary references, considered by many to be the international benchmarks for commercially based telecommunications components and installations, are standards ANSI/TIA/EIA-568-A (/568) Commercial Building Telecommunications Cabling Standard and 150/IEC 11801 (/11801), generic cabling for customer premises. Among the many aspects of telecommunications cabling covered by these standards are connecting hardware design, reliability and transmission performance. Accordingly, the industry has established a common set of test methods and pass/fail criteria on which performance claims and comparative data may be based.

To determine connecting hardware performance in a data environment, it is preferred to establish test methods and pass/fail criteria that are relevant to a broad range of applications and connector types. Since the relationship between megabits and megahertz depends on the encoding scheme used, performance claims for wiring components that specify bit rates without providing reference to an industry standard or encoding scheme are of little value.

Therefore, it is in the interest of both manufacturers and end users to standardize performance information across a wide range of applications. For this reason, application independent standards, such as /568 and /11801, specify performance criteria in terms of hertz rather than bits. This information may then be applied to determine if requirements for specific applications are complied with. For example, many of the performance requirements in the IEEE 802.3i(10BASE-T) standard are specified in megahertz, and although data is transmitted at 10 Mbps for this application, test "frequencies" are specified in the standard (as high as 15 MHZ). Transmission parameters defined in /568 and /11801 for twisted-pair connectors include attenuation, near-end crosstalk (NEXT) and return loss. The net effect of these parameters on channel performance may be expressed in signal-to-noise ratio (SNR). For connecting hardware, the parameter that has been found to have the greatest impact on SNR is near-end crosstalk.

Several industry standards that specify multiple performance levels of twisted-pair cabling components have been established. For example, Category 3, 4 and 5 cable and connecting hardware are specified in both /568 and /11801, as well as other national and regional specifications. In these specifications, transmission requirements for Category 3 components are specified up to 16 MHZ. Transmission requirements for Category 4 components are specified up to 20 MHZ. Transmission requirements for Category 5 components are specified up to 100 MHZ. The category 5 classification defines the most severe transmission requirements specified by national and international standards for unshielded and screened twisted-pair cabling.

In order for a twisted-pair connector to be qualified for a given performance category, it must meet all applicable transmission requirements regardless of design or intended use. The challenge of meeting transmission criteria is compounded by the fact that connector categories apply to worst case performance. For example, a work area outlet that meets Category 5 NEXT requirements for all combinations of pairs except one, which meets Category 3, may only be classified as a Category 3 connector (provided that it meets all other applicable requirements).

It is recognized that there are numerous ways of achieving electrical balance for connecting hardware of the type that is disclosed by the present invention. Several Category 5 type outlet connectors are presently commercially available. These include Systemax SCS Category 5 Products from AT&T Network Systems, DVO Plus and BIX Plus from Northern Telecom and the Category 5 ACO outlet from AMP. This list is only exemplary and is not intended to be a complete listing of Category 5 type products that are presently commercially available. Accordingly, there is a continuing need for improved outlet connectors which meet or exceed Category 5 performance requirements in order to satisfy increasing bandwidth requirements of communication systems and networks.

The Systemax SCS Category 5 outlet from AT&T network systems uses a "cross-over lead" concept which achieves a desired level of crosstalk performance without the use of printed wiring boards or other additional components (U.S. Pat. No. 5,186,647 to Denkman et al). This product uses a variation of the well known lead-frame outlet construction that has been in use for many years by numerous companies. Although this approach offers potential cost benefits by minimizing the quantity and types of components in the completed assembly, it is limited in several major respects.

It will be appreciated that other methods of balance compensation exist, such as selective parallel runs of circuit traces either in a side-by-side configuration of overlapping traces placed on adjacent layers of a circuit board. It is also possible to vary trace thickness in order to achieve a degree of inductive balance correction between pairs. Another method is to lay a piece of flexible printed circuit (FPC) on top of an array of contacts. Selected contacts are electrically connected to portions of flexible printed circuit (FPC). Some of these methods are disclosed in U.S. Pat. No. 5,299,956, Brownell. Yet another method of achieving balance between pairs that employs neither lead-frame or printed circuit construction is to selectively twist wire leads that exit the back of a conventional modular outlet. However, each of these methods has its own inherent limitations in terms of repeatability, cost and performance. For example, passive FPC over lead flame designs include drawbacks such as resonating crosstalk. Where twisted wire leads are employed, inconsistency is problematic and cost is high.

An ITT Cannon modular outlet having reduced crosstalk comprises a connector housing with a contact carrier received therein, which supports a plurality of contacts. A hinged termination cover is attached to the housing for terminating a plurality of wires at one end of the contacts. Using the T568A pin/pair scheme defined in standard /568, the R4 contact comprises an insulation displacement terminal connected by a plate to a modular outlet terminal. The T4 contact comprises an insulation displacement (IDC) terminal connected by a lead to a modular outlet terminal. The T1 contact comprises an insulation displacement terminal connected by a plate to a modular outlet terminal. The R1 contact comprises an insulation displacement terminal connected by a plate to a modular outlet terminal. The R3 contact comprises an insulation displacement terminal connected by a lead to a modular outlet terminal. The T3 contact comprises an insulation displacement terminal connected by a plate to a modular outlet termination. The R2 contact comprises an insulation displacement terminal connected by a first lead to a modular outlet terminal. A second lead of the R2 contact extends from one side of the first lead of the R2 contact and terminates in a first plate of the R2 contact. A third lead of the R2 contact extends from the other side of the first lead of the R2 contact and terminates in a second plate of the R2 contact. The T2 contact comprises an insulation displacement terminal connected by a first lead of the T2 contact to a modular outlet terminal. A second lead of the T2 contact extends from one side of the first lead of the T2 contact and terminates in a first plate of the T2 contact. A third lead of the T2 contact extends from the other side of the first lead of the T2 contact and terminates in a second plate of the T2 contact.

The plate of the R4 contact is disposed over the second plate of the R2 contact and the plate of the R1 contact is disposed over the first plate of the R2 contact, with a dielectric sheet disposed therebetween. Accordingly, capacitive coupling is induced or added between the R2 contact and the R4 and R1 contacts. Further, the plate of the T1 contact is disposed above the second plate of the T2 contact and the plate of the T3 contact is disposed above the first plate of the T2 contact, with the dielectric sheet disposed therebetween. Accordingly, capacitive coupling is induced or added between the T2 contact and the T1 and T3 contacts.

It is important to note that these plates are shunt circuits connected to the signal carriers such that electrical current does not pass through the plates in order to allow the signal to pass from input to output. Such passive capacitive plates suffer from the known problem of resonating crosstalk, a phenomena believed to result from signal reflection and/or lack of signal balance.

In general, prior art modular outlets also have the following limitations.

Many prior art modular outlets have IDC terminals sequenced in accordance with the wiring scheme of T568A or T568B of/568. These IDC terminal sequences require that one of the twisted wire pairs be untwisted and split which has a detrimental effect on crosstalk performance.

The prior art modular outlets, when installed into a panel, cannot be stacked side by side. In applications where higher outlet density is required, the prior art arrangements sacrifice space efficiency.

Many prior art modular outlets are installable into proprietary panel openings, which limit the outlets' adaptability to various applications.

The prior art modular outlets must be installed into a panel opening from the rear of the panel. In actual installations, most users prefer to install a terminated outlet from the front of the panel.

Many prior art outlets which employ a termination cap require extensive cable preparation, before a cable can be attached to the termination cap. In general, each twisted pair must be untwisted. Each of the individual wires must be straightened, aligned, and if necessary, trimmed, before the cable can be installed onto a termination cap.

A disadvantage of the ITT outlet is that it requires four discrete housing, components. The living hinge design has the limitations of restricting material selection and compromised mechanical integrity.

Known doors for prior art outlets are generally spring loaded whereby they are not retainable in an open position but only in a closed position. This disadvantage requires a user to use two hands when installing a plug, i.e., one to hold the door open and the other to install the plug.

SUMMARY OF THE INVENTION

The above-discussed and other drawbacks and deficiencies of the prior art are overcome or alleviated by a modular outlet employing the door assembly of the present invention. The present invention teaches an outlet door assembly that is retainable in both an open and a closed position. In accordance with the present invention, the door comprises a pair of mounting arms having inwardly extending protrusions which are received in notches for retaining the door in the closed and open position. In one embodiment the connector housing has an outwardly extending protrusion within each of a pair of notches to define the positions for retaining the protrusions of the door arms. In another embodiment a door holder is employed which has pairs of notches, with one pair of notches receiving the protrusions of the door arms therein for retaining the door in a closed position and another pair of notches receiving the protrusions of the door arms therein for retaining the door in an open position. In both embodiments the door includes a channel for receiving an identification icon therein.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES:

FIGS. 2A and B are perspective views of a modular outlet in accordance with the present invention wherein FIG. 2A is taken from the front thereof and FIG. 2B is taken from the rear thereof;

FIGS. 3A and B are partially exploded perspective views of the modular outlet of FIGS. 2A and B wherein FIG. 3A is taken from the front thereof and FIG. 3B is taken from the rear thereof;

FIGS. 4A and B are fully exploded perspective views of the modular outlet of FIGS. 2A and B wherein FIG. 4A is taken from the top thereof and FIG. 4B is taken from the bottom thereof;

FIGS. 5A and B are views of contacts in an assembled configuration for use with the modular jack of FIGS. 2A and B wherein FIG. 5A is a perspective view thereof and FIG. 5B is an exploded view thereof;

FIGS. 6A and B are perspective views of a contact carrier for use with the modular outlet of FIGS. 2A and B wherein FIG. 6A is taken from the front thereof and FIG. 6B is taken from the bottom thereof;

FIGS. 7A and B are perspective views of a termination cap for use with the modular outlet of FIGS. 2A and B wherein FIG. 7A is taken from the rear thereof and FIG. 7B is taken from the front thereof;

FIGS. 8A–D are views of an insert for use with the modular outlet of FIGS. 2A and B wherein FIG. 8A is a top view thereof, FIG. 8B is a bottom view thereof, FIG. 8C is an end view thereof, and FIG. 8D is a side elevation view thereof;

FIGS. 10A–C are views of contacts in an assembled configuration, in accordance with an alternate embodiment, for use with the modular outlet of FIGS. 2A and B wherein FIG. 10A is a front perspective view thereof, FIG. 10B is an exploded perspective view thereof, and FIG. 10C is a rear perspective view thereof;

FIGS. 11A and 11B are perspective views of a modular outlet in accordance with the present invention wherein FIG. 11A is taken from the front thereof and FIG. 11B is taken from the rear thereof;

FIGS. 12A and 12B are partially exploded perspective views of the modular outlet of FIGS. 11A and B wherein FIG. 12A is taken from the front thereof and FIG. 12B is taken from the rear thereof;

FIGS. 13A and 13B are fully exploded perspective views of the modular outlet of FIGS. 11A and B wherein FIG. 13A is taken from the top thereof and FIG. 13B is taken from the bottom thereof;

FIGS. 14A and 14B are perspective views of a contact carrier for use with the modular outlet of FIGS. 11A and B wherein FIG. 14A is taken from the front thereof and FIG. 14B is taken from the bottom thereof;

FIGS. 15A and 15B are perspective views of a termination cap for use with the modular outlet of FIGS. 11A and B wherein FIG. 15A is taken from the rear thereof and FIG. 15B is taken from the front thereof;

FIGS. 16A and 16B are perspective views of a modular outlet in accordance with the present invention wherein FIG. 16A is taken from the front thereof and FIG. 16B is a partially exploded view with the door detached;

DESCRIPTION OF THE PREFERRED EMBODIMENT

Figure 1:
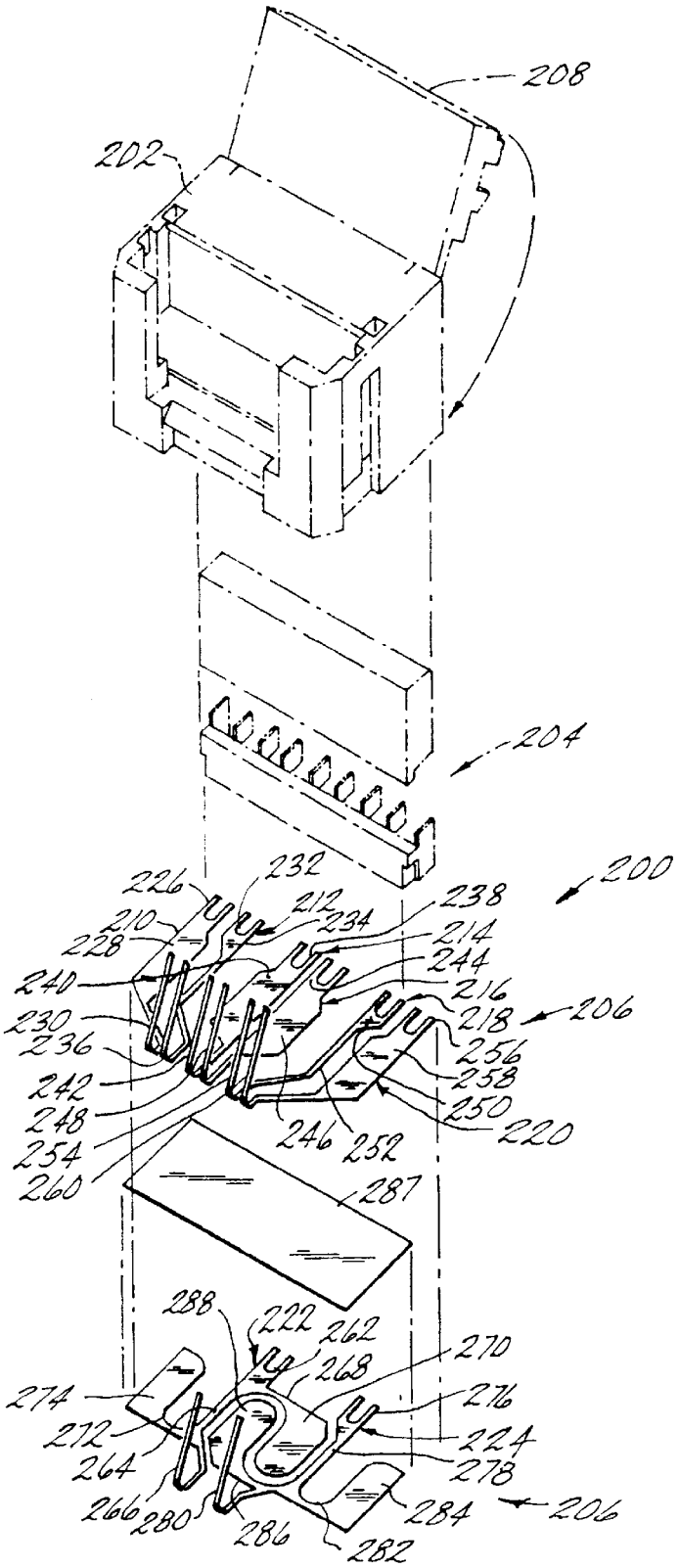
FIG. 1 (PRIOR ART)
FIG. 1 is a perspective view of a modular outlet in accordance with the prior art.
Figure 2A:
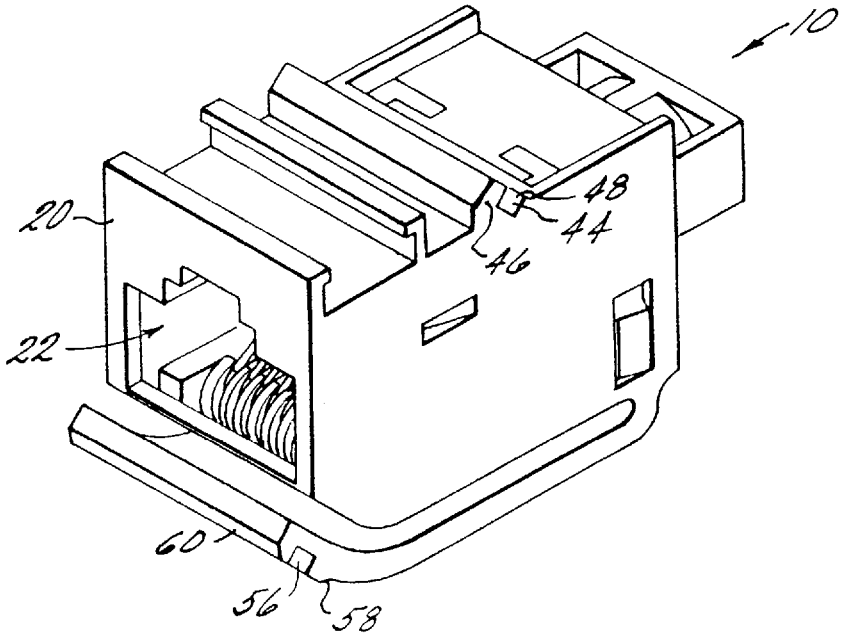
Figure 2B:
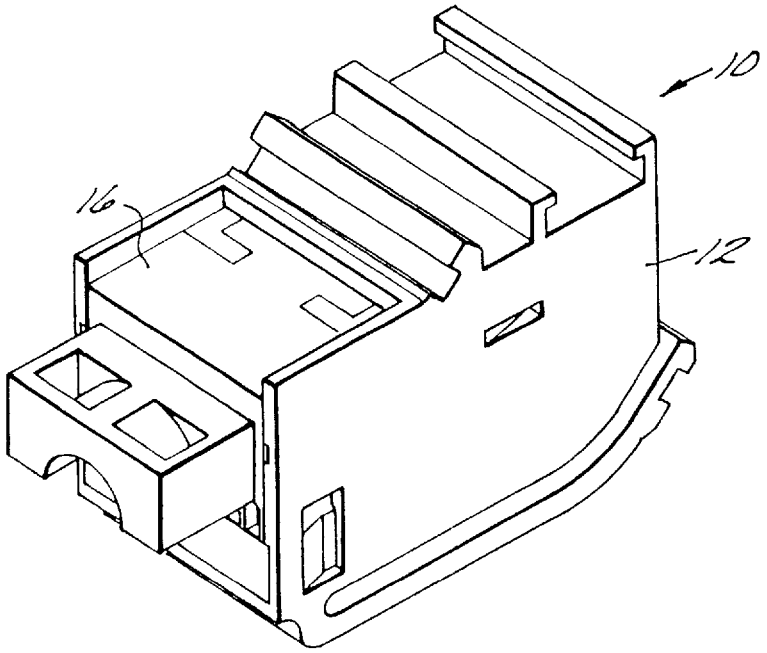
Figure 3A:
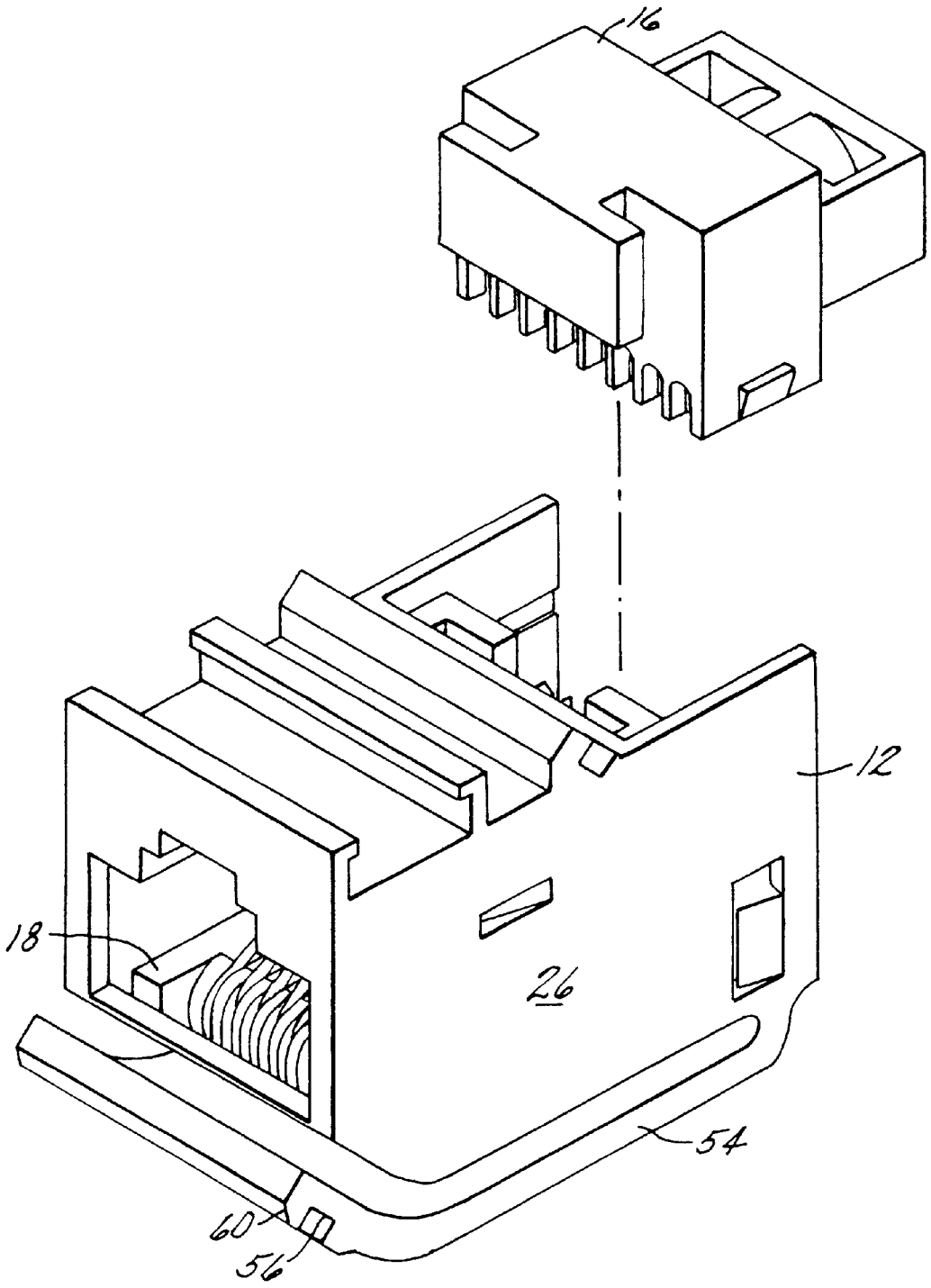
Figure 3B:
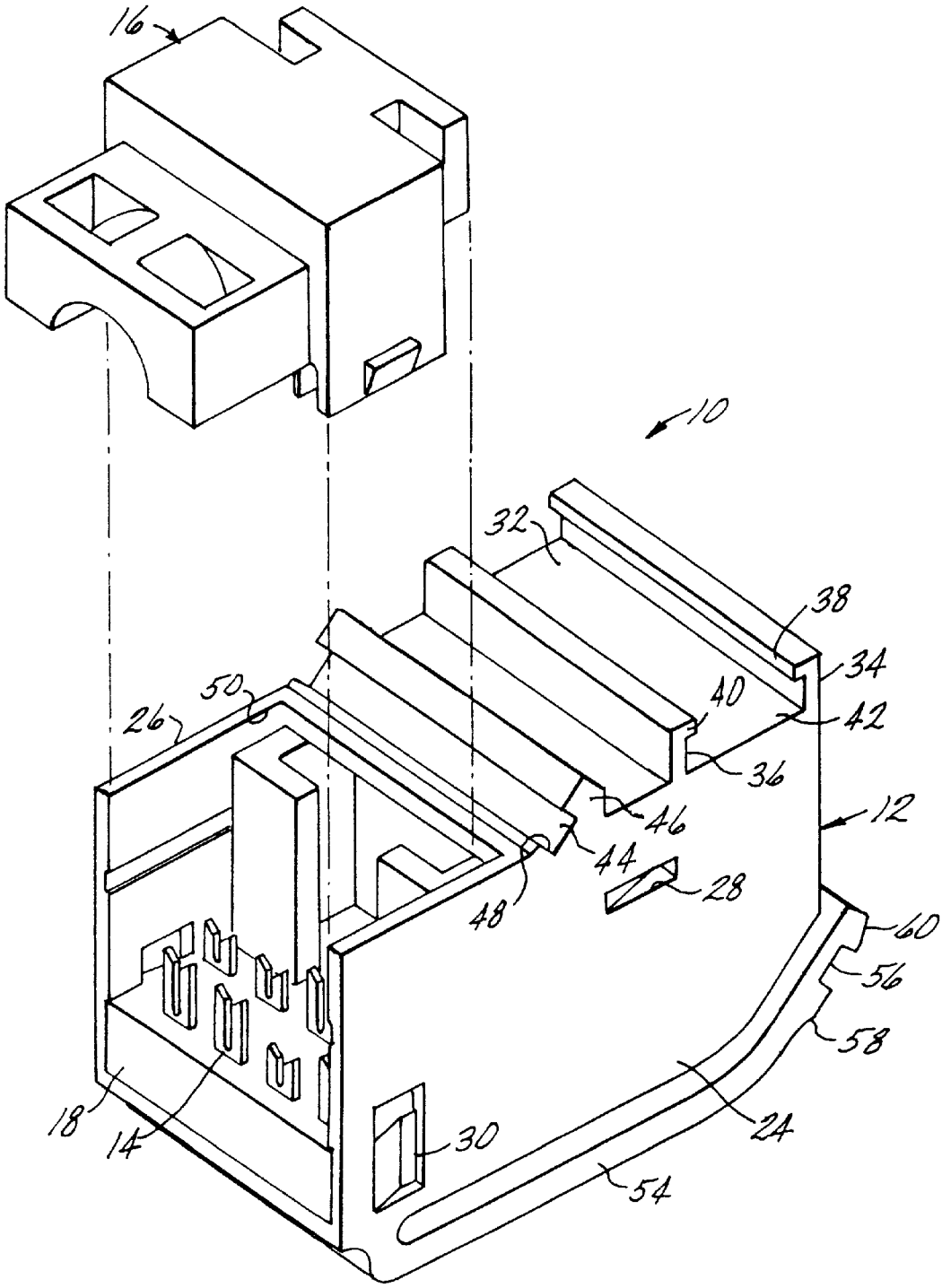
Figure 4A:
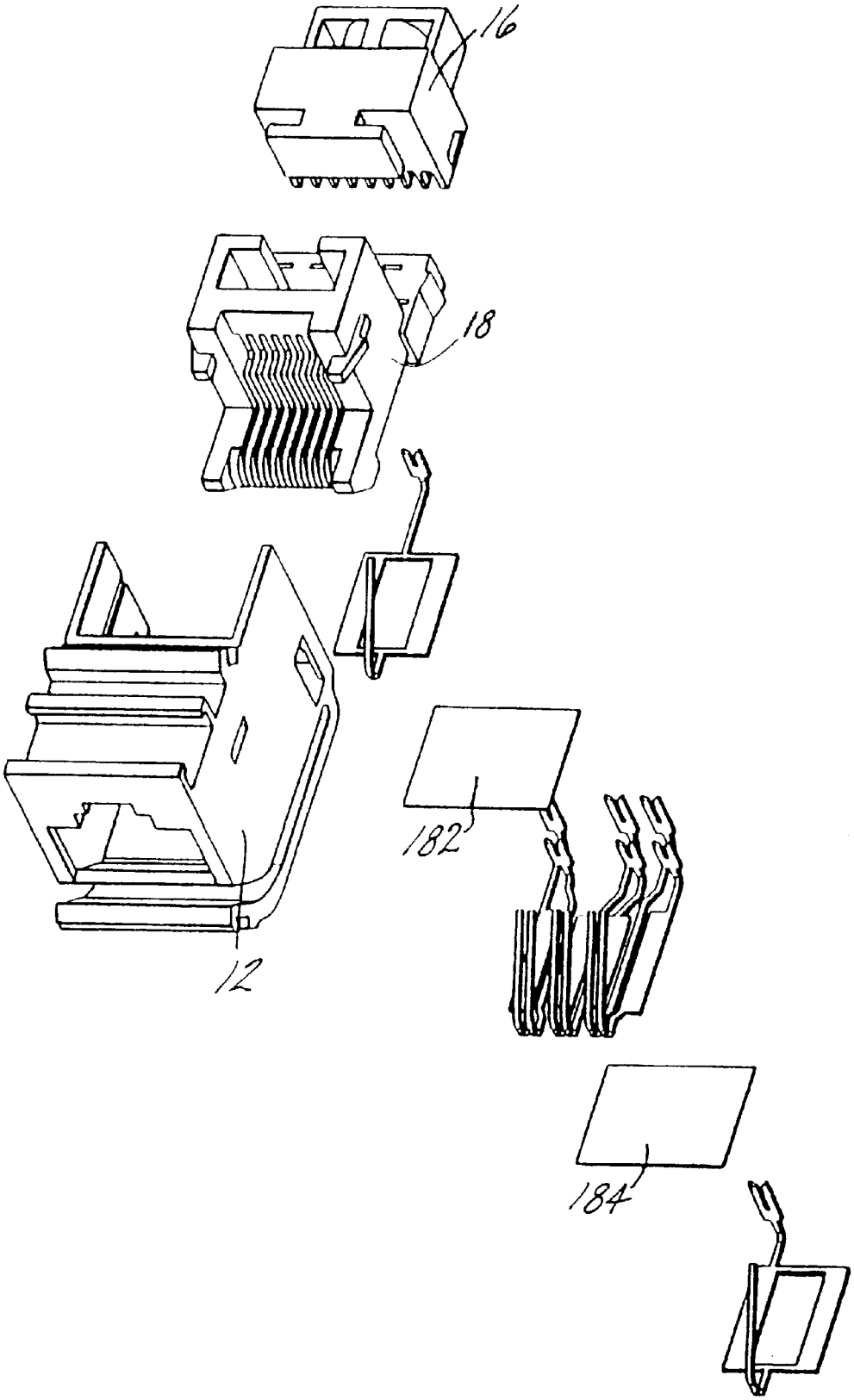
Figure 4B:
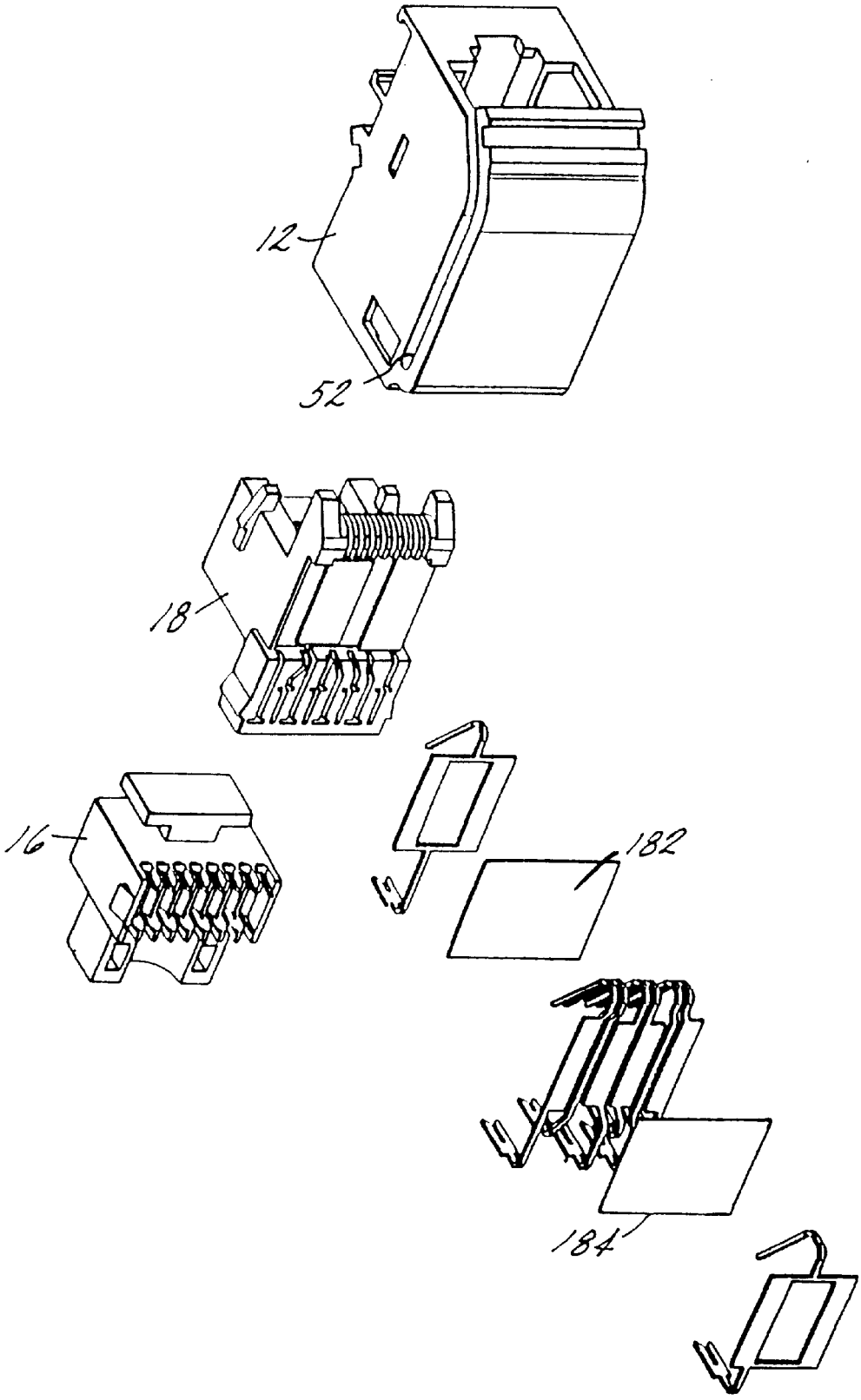

Referring to FIG. 1, a subassembly of a modular outlet having reduced crosstalk in accordance with the prior art is generally shown at 200. Subassembly 200 comprises a connector housing 202 with a contact carrier 204 received therein, which supports a plurality of contacts 206. A hinged termination cover 208 is attached to housing 202 for terminating a plurality of wires at one end of contacts 206.

Contacts 206 comprise eight contacts 210, 212, 214, 216, 218, 220, 222 and 224. Contact 210 comprises an insulation displacement terminal 226 connected by a plate 228 to a modular outlet terminal 230 (i.e., pin 8, R4 in accordance with T568A). Contact 212 comprises an insulation displacement terminal 232 connected by a lead 234 to a modular outlet terminal 236 (i.e., pin 7, T4 in accordance with T568A). Contact 214 comprises an insulation displacement terminal 238 connected by a plate 240 to a modular outlet terminal 242 (i.e., pin 5, T1 in accordance with T568A). Contact 216 comprises an insulation displacement terminal 244 connected by a plate 246 to a modular outlet terminal 248 (i.e., pin 4, R1 in accordance with T568A). Contact 218 comprises an insulation displacement terminal 250 connected by a lead 252 to a modular outlet terminal 254 (i.e., pin 2, R3 in accordance with T568A). Contact 220 comprises an insulation displacement terminal 256 connected by a plate 258 to a modular outlet termination 260 (i.e., pin 1, T3 in accordance with T568A). Contact 222 comprises an insulation displacement terminal 262 connected by a lead 264 to a modular outlet terminal 266 (i.e., pin 6, R2 in accordance with T568A). A lead 268 extends from one side of lead 264 and terminates in a plate 270. A lead 272 extends from the other side of lead 264 and terminates in a plate 274. Contact 224 comprises an insulation displacement terminal 276 connected by a lead 278 to a modular outlet terminal 280 (i.e., pin 3, T2 in accordance with T568A). A lead 282 extends from one side of lead 278 and terminates in a plate 284. A lead 286 extends from the other side of lead 278 and terminates in a plate 288.

Plate 228 of contact 210 is disposed over plate 274 of contact 222 and plate 246 of contact 216 is disposed over plate 270 of contact 222, with a dielectric sheet 287 (e.g., Mylar™ or Kapton™) disposed therebetween. According, capacitive coupling is induced or added between contact 222 (i.e., pin 6, R2 in accordance with T568A) and contacts 226 (i.e., pin 8, R4 in accordance with T568A) and 216 (i.e., pin 4, R1 in accordance with T568A). Further, plate 240 of contact 214 is disposed above plate 288 of contact 224 and plate 258 of contact 220 is disposed above plate 284 of contact 224, with dielectric sheet 287 disposed therebetween. According, capacitive coupling is induced or added between contact 224 (i.e., pin 3, T2 in accordance with T568A) and contacts 214 (i.e., pin 5, T1 in accordance with T568A) and 220 (i.e., pin 1, T3 in accordance with T568A).

It is important to note that these plates are shunt circuits connected to the signal carriers such that electrical current does not pass through the plates in order to allow the signal to pass from input to output. Such passive capacitive plates suffer from the known problem of resonating crosstalk, a phenomena believed to result from signal reflection and/or lack of signal balance. This contact arrangement has the additional disadvantage of requiring that one wire pair such as pair 2 of T568A be terminated on contact positions that are not adjacent and that the positioning of tip and ring conductors are not consistent for all pairs.

The modular outlet of the present invention does not employ such passive plates, thereby avoiding the problem of resonating crosstalk. Referring to FIGS. 2A–B, 3A–B, and 4A–B, a modular outlet having reduced crosstalk is shown generally at 10. Modular outlet 10 comprises a connector housing 12 with a contact carrier 18 received therein, which supports a plurality of contacts 14. A termination cap 16 mated to housing 12 for terminating a plurality of wires at one end of contacts 14.

Figure 8B:
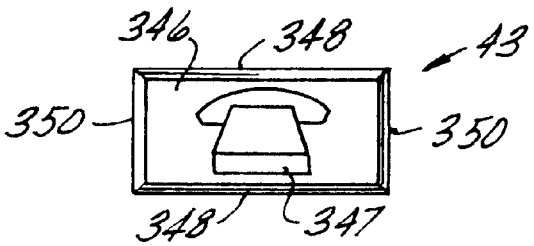
Figure 8D:
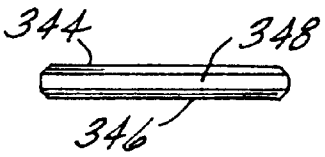
Figure 8A:
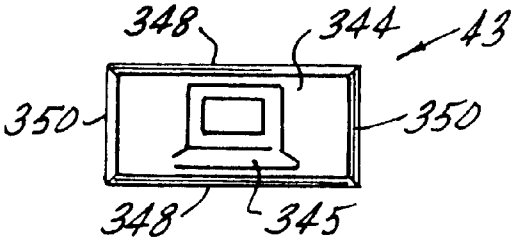
Figure 8C:
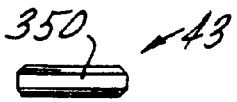
Figure 9:
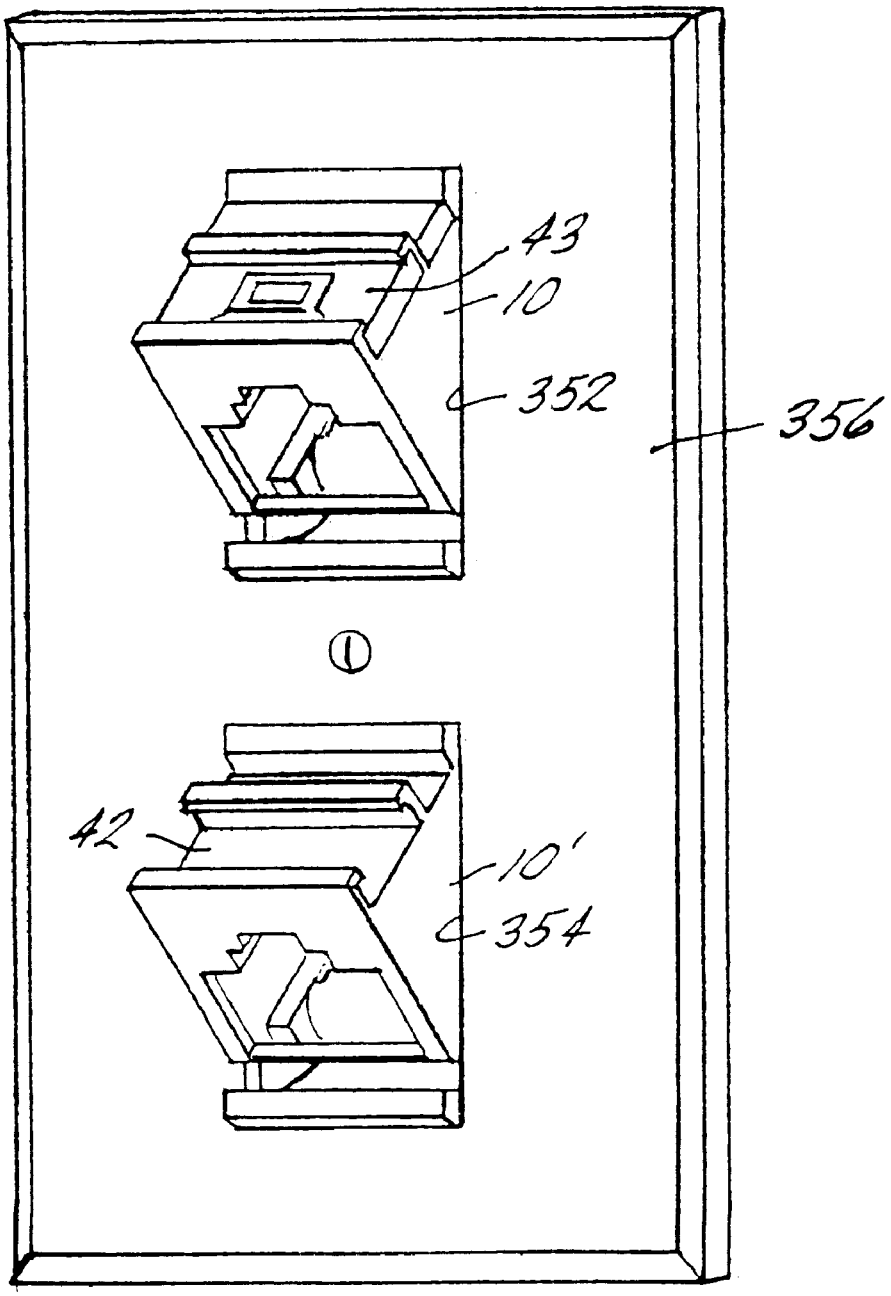
FIG. 9 is a front perspective view of two of the modular outlets of FIGS. 2A and B inserted in a wall plate in accordance with the present invention.

Connector housing 12 comprises a front panel 20 having a standard modular outlet opening 22 therein, as is well known, e.g., an 8-position or 6-position outlet opening as specified in IEC 603-7 and FCC CFR 47, part 68, subpart F. A pair of side panels 24 and 26 depend rearwardly from panel 20. Each panel 24 and 26 has mounting holes 28 and 30 therein. A top panel 32 extends rearwardly from panel 20. A pair of cooperating uprights 34, 36 terminating with retaining ledges 38, 40 define a slot 42 for receiving an icon or insert 43 (FIGS. 8A–B), as described more fully hereinafter. A panel receiving slot 44 is defined by an angled upright 46 and an angled surface 48. A bottom panel 52, opposite top panel 32, extends rearwardly from panel 20. Panel 52 is curved upwardly at the front end thereof. A resilient panel 54 depends from the rear end of panel 52 and generally follows the contour thereof. A panel receiving slot 56 is defined at the front end of panel 54 and includes inclined surfaces 58, 60 on each side thereof to aid in the insertion and removal of modular outlet 10 from and/or to a plate or panel (FIG. 9).

Contact carrier 18 comprises a front generally L-shaped portion 62 receptive to a standard modular outlet and having a plurality of slots 64 therein for receiving contacts 14. Slots 64 are defined in arcuate recess 66 at the front end of the lower leg portion 68 and in a channel 70 in the front surface of upper leg portion 72. A second channel 74 is defined in the back surface of upper leg portion 72. The front end of lower leg portion 68 is inclined to cooperate with the curved front end of panel 52 when contact carrier 18 is inserted in connector housing 12. To retain contact carrier 18 within connector housing 12 arms 76, 78 are provided. Arms 76 and 78 each include an inclined surface 80 to aid in the insertion of contact carrier 18 in connector housing 12 from the rear thereof and retaining edges 82. Retaining edges 82 engage and are received in holes 28 of side panels 24 and 26. A termination block portion 84 depends rearwardly from the lower end of leg portion 72. Block portion 84 includes a plurality of slots 86 at the lower portion thereof for receiving contacts 14. The lower portion itself comprises three distinct surfaces on three distinct levels for positioning of contacts. The surfaces are illustrated in FIG. 6B and are identified by numerals 85*a*, 85*b*, and 85*c*. Each of the surfaces allow for positioning of desired contacts. Furthermore the surfaces, because they are molded into the carrier itself provide mechanical stability for the individual contacts in each of the surfaces on which they are positioned. It should be understood that the slots 64 also include three different levels of surfaces 85*a*, 85*b* and 85*c* to correspond to those surfaces illustrated in FIG. 6B. Each slot 86 communicates with an opening 88 which extends through block portion 84, where corresponding contacts 14 pass through. A ramped surface 90 defining a retaining ledge 92 is defined at each side 94, 96 of block portion 84. A recess 98 is defined between block portion 84 and a downward extension 100 of lower leg portion 68. Recess 98 receives portions of contacts 14 when they are installed on contact carrier 18.

Figure 5B:
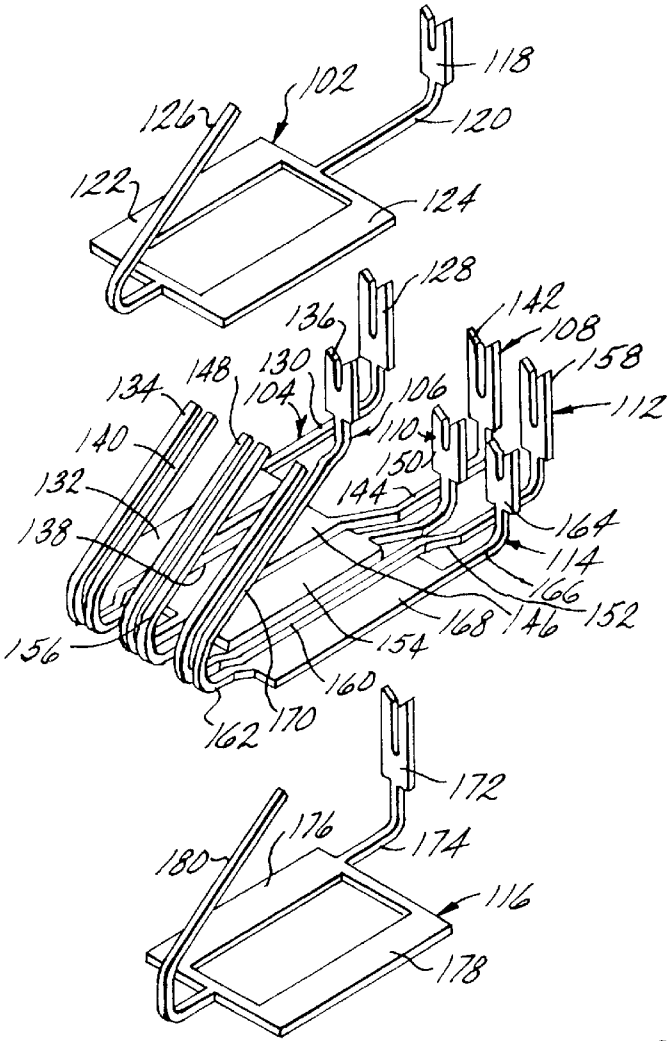
Figure 5A:
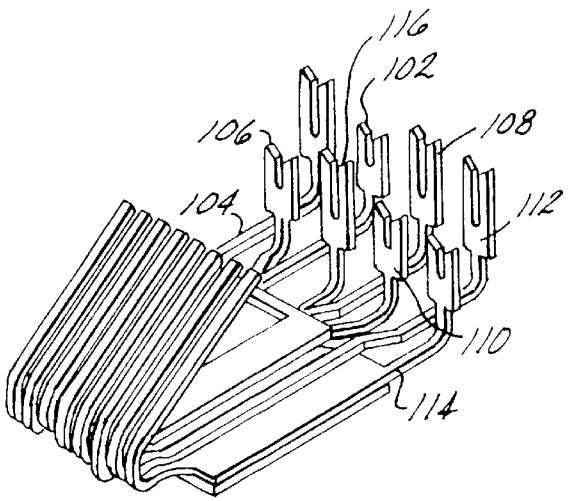

Referring to FIGS. 5A–B, prior to insertion of contact carrier 18 in connector housing 12, contacts 14 must be installed. Contacts 14, in the present example, comprise eight contacts 102, 104, 106, 108, 110, 112, 114 and 116. Contact 102 comprises an insulation displacement terminal 118 connected by a lead 120 to plates 122 and 124 which are connected to a modular outlet terminal (i.e., a resilient wire) 126 (i.e., pin 6, R2 in accordance with T568A). Contact 104 comprises an insulation displacement terminal 128 connected by a lead 130 to a plate 132 which is connected to a modular outlet terminal 134 (i.e., pin 8, R4 in accordance with T568A). Contact 106 comprises an insulation displacement terminal 136 connected by a lead 138 to a modular outlet terminal 140 (i.e., pin 7, T4 in accordance with T568A). Contact 108 comprises an insulation displacement terminal 142 connected by a lead 144 to a plate 146 which is connected to a modular outlet terminal 148 (i.e., pin 5, T1 in accordance with T568A). Contact 110 comprises an insulation displacement terminal 150 connected by a lead 152 to a plate 154 which is connected to a modular outlet terminal 156 (i.e., pin 4, R1 in accordance with T568A). Contact 112 comprises an insulation displacement terminal 158 connected by a lead 160 to a modular outlet terminal 162 (i.e., pin 2, R3 in accordance with T568A). Contact 114 comprises an insulation displacement terminal 164 connected by a lead 166 to a plate 168 which is connected to a modular outlet terminal 170 (i.e., pin 1, T3 in accordance with T568A). Contact 116 comprises an insulation displacement terminal 172 connected by a lead 174 to plates 176 and 178 which are connected to a modular outlet terminal 180 (i.e., pin 3, T2 in accordance with T568A). Contacts are generally secured in position by conventional means of ultrasonic welding, swaging, staking, adhesive, etc.

It is an important feature of the present invention, that plate 122 of contact 102 is disposed over plate 132 of contact 104 and plate 124 of contact 102 is disposed over plate 154 of contact 110, with a dielectric sheet 182 (e.g., Mylar™ or Kapton™) disposed therebetween. According, capacitive coupling is induced or added between contact 102 (i.e., pin 6, R2 in accordance with T568A) and contact 104 (i.e., pin 8, R4 in accordance with T568A), and between contact 102 (i.e., pin 6, R2 in accordance with T568A) and contact 110 (i.e., pin 4, R1 in accordance with T568A). Further, plate 176 of contact 116 is disposed below plate 146 of contact 108 and plate 178 of contact 116 is disposed below plate 168 of contact 114, with a dielectric sheet 184 (e.g., Mylar™ or Kapton™) disposed therebetween. According, capacitive coupling is induced or added between contact 116 (i.e., pin 3, T2 in accordance with T568A) and contact 108 (i.e., pin 5, T1 in accordance with T568A), and between contact 116 (i.e., pin 3, T2 in accordance with T568A) and contact 114 (i.e., pin 1, T3 in accordance with T568A).

It is also an important feature of the present invention, that plates 122, 124, 132, 146, 154, 168, 176 and 178 are current carrying. More specifically, current through these contacts, either from the insulation displacement terminal to the modular outlet terminal or vise versa, must travel through the plates which form the capacitive coupling.

This method of achieving a controlled amount of capacitive coupling between selected contacts is an important feature of the present invention, whereby reactive imbalance between pairs that is caused by certain outlet wiring schemes and wire connectors is compensated for, by the plates and dielectric sheets, so as to allow the modular outlet of the present invention to meet or exceed Category 5 requirements as described hereinbefore without the common problems of resonating crosstalk of passive plates in the prior art. The benefits of Category 5 devices are well known and are readily appreciated by one of ordinary skill in the art. The most significant being the substantial cost savings in using unshielded twisted pair wire where shielded, co-axial or fiber optic cable has been used in the past due to bandwidth limitations of the twisted-pair.

Figure 6A:
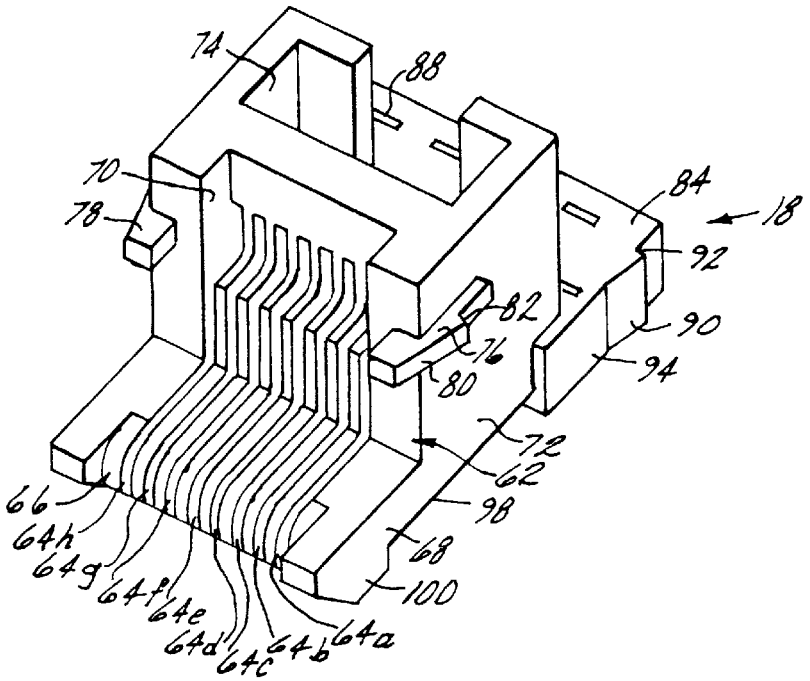
Figure 6B:
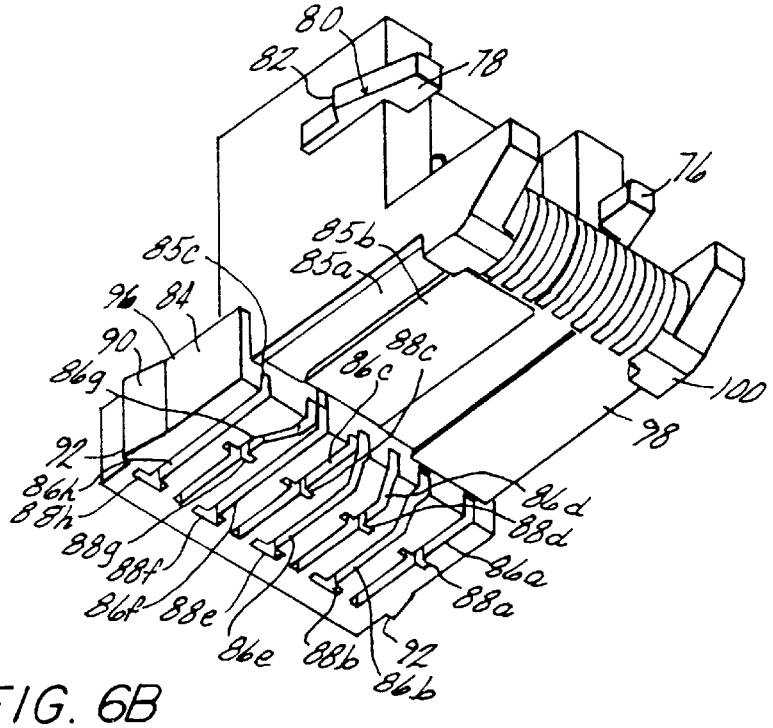

Referring to FIGS. 6A–B, contact 102 is installed on contact carrier 18 with terminal 126 disposed in slot 64*f*, lead 120 disposed in slot 86*f*, and terminal 118 inserted through opening 88*f*. Contact 104 is installed on contact carrier 18 with terminal 134 disposed in slot 64*h*, lead 130 disposed in slot 86*g*, and terminal 128 inserted through opening 88*g*. Contact 106 is installed on contact carrier 18 with terminal 140 disposed in slot 64*g*, lead 138 disposed in slot 86*h*, and terminal 136 inserted through opening 88*h*. Contact 108 is installed on contact carrier 18 with terminal 148 disposed in slot 64*e*, lead 144 disposed in slot 86*e*, and terminal 142 inserted through opening 88*e*. Contact 110 is installed on contact carrier 18 with terminal 156 disposed in slot 64*d*, lead 152 disposed in slot 86*d*, and terminal 150 inserted through opening 88*d*. Contact 112 is installed on contact carrier 18 with terminal 162 disposed in slot 64*b*, lead 160 disposed in slot 86*a*, and terminal 158 inserted through opening 88*a*. Contact 114 is installed on contact carrier 18 with terminal 170 disposed in slot 64*a*, lead 166 disposed in slot 86*b*, and terminal 164 inserted through opening 88*b*. Contact 116 is installed on contact carrier 18 with terminal 180 disposed in slot 64*c*, lead 174 disposed in slot 86*c*, and terminal 180 inserted through opening 88*c*.

It is an important feature of the present invention that while the modular outlet terminals are positioned in accordance with a standard configuration, e.g., T568A, the insulation displacement terminals are configured to improve wiring termination. More specifically, sequential terminals 164 and 158 correspond to T3 and R3, respectively; sequential terminals 142 and 150 correspond to T1 and R1, respectively; sequential terminals 172 and 118 correspond to T2 and R2, respectively; and sequential terminals 136 and 128 correspond to T4 and R4, respectively. In standard T568A terminals wire pair T2 and R2 are split, i.e., not sequential, thereby requiring that at least this pair be partially untwisted at this termination. Maintaining the integrity of the twisted wire configuration is significant in high bandwidth applications, e.g., Category 5 or the emerging ATM standards. In accordance with this objective, the untwisting of conductors is to be minimized, whereby the termination configuration of the present invention aids in limiting this problem by eliminating the pair split when terminating.

Figure 7B:
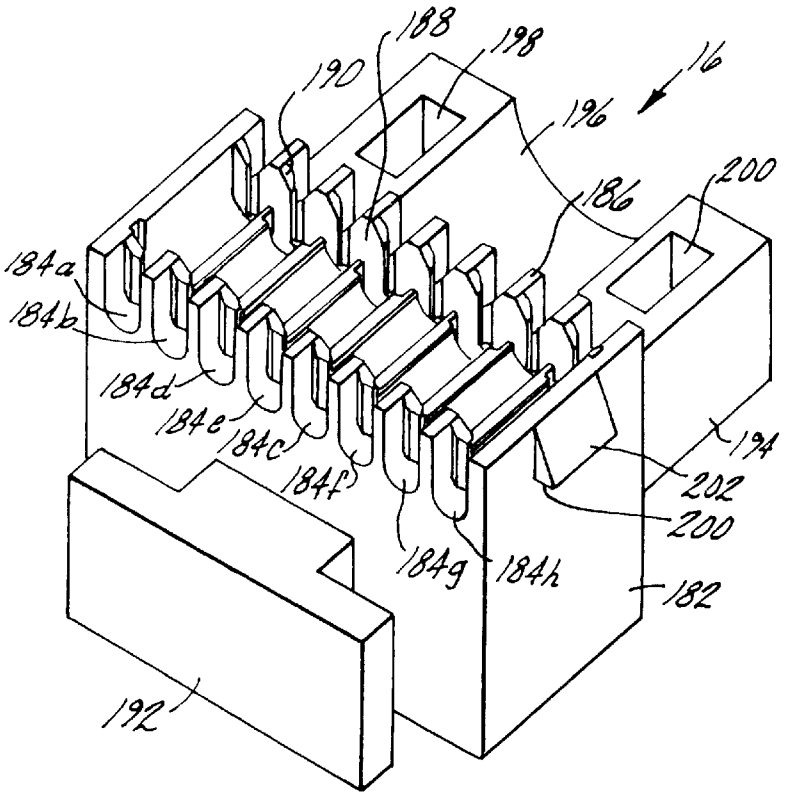
Figure 7A:
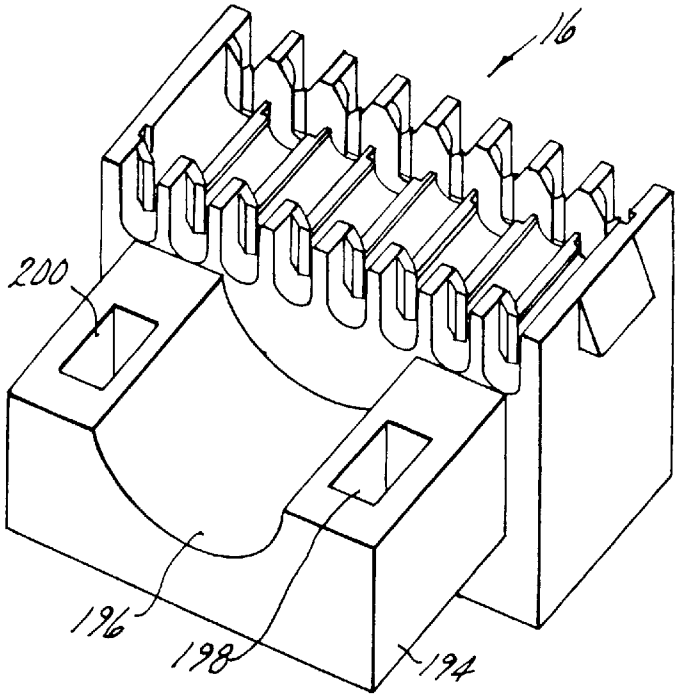

Referring to FIGS. 7A–B, termination cap 16 comprises a termination block portion 182 having a row of wire retaining slots 184 defined by a plurality of teeth 186. Teeth 186 include an interior flange 188 which grips a wire by its insulation. Interior flange 188 has tapered ends 190 to facilitate wire entry. A T-shaped block 192 depends from a front end of termination block portion 182 and a jacket retaining block 194 depends from an opposing rear end of termination block portion 182. Block 194 includes an arcuate recess 196 for receiving the jacket of a cable to be terminated and includes holes 198 and 200 therethrough. The cable being terminated is secured to portion 182 by inserting a cable tie (not shown) through one of the holes, around the cable, through the other one of the holes, and mating the cable tie, as is well known. By way of example, in accordance with T568A standards and the improved termination configuration of the present invention; wire T3 is inserted in slot 184*a*, wire R3 is inserted in slot 184*b*, wire R1 is inserted in slot 184*d*, wire T1 is inserted in slot 184*e*, wire T2 is inserted in slot 184*c*, wire R2 in inserted in slot 184*f*, wire T4 is inserted in slot 184*g*, and wire R4 is inserted in slot 184*h*.

Once the wires have been inserted into the slots of the termination cap and the cable secured thereto, the wires are cut if they extend beyond the slots and the wires are terminated onto respective insulation displacement terminals. The wires are terminated by inserting block 192 into channel 74 of contact carrier 18, thereby aligning the termination cap with on the contact carrier, and pushing downwardly until the insulation displacement terminals displace the insulation on the wires and electrically connect with the conductive wire, (i.e., a mass termination). Termination cap 16 is retained on contact carrier 18 by retaining surfaces 200 and associated ramped surfaces 202, with surfaces 200 being engaged in holes 30 of connector housing 12, on top of the protrusions defined by surfaces 90 and 92 of contact carrier 18. Accordingly, each hole 30 serves to retain or engage both contact carrier 18, by way of retaining ledges 92, and termination cap 16, by way of retaining surfaces 200.

Referring to FIGS. 8A–D, insert 43 comprises a pair of opposing surfaces 344, 346 and first and second opposing sides 348, 350. The edges of surfaces 344 and 346 are chamfered. Insert 43 is inserted into slot 42 of connector housing 12 and is retained therein by friction between these parts. Inserts 43 may include designations on either surface 344 or 346, or be color coded. A computer terminal 345 is illustrated on surface 344 (FIG. 8A) and a telephone 347 is illustrated on surface 346 (FIG. 8B), by way of example only. It will be appreciated that any designation symbol or term may be molded into or imprinted on these surfaces, as such will be dictated by the particular application of the modular outlet.

Referring to FIG. 9, two modular outlets 10, 10' are shown installed in corresponding openings 352, 354 of a wall plate 356. Slots 44 and 58 of each of the modular outlets receive corresponding edges of the wall plated at the openings. As is clearly shown in this FIGURE, the modular outlets provide for a gravity feed thereto, the advantages of which are well known, see for example, U.S. Pat. No. 5,362,254 to Siemon et al., which is incorporated herein by reference.

Figure 10A:
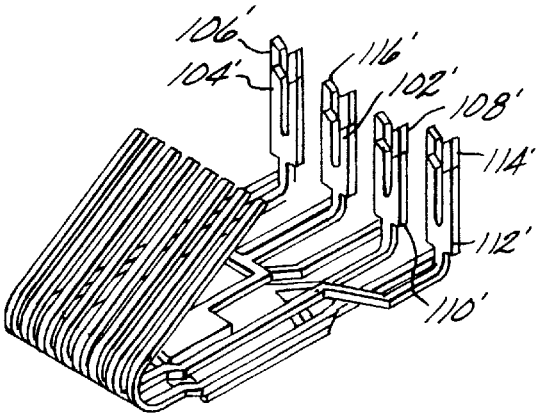
Figure 10B:
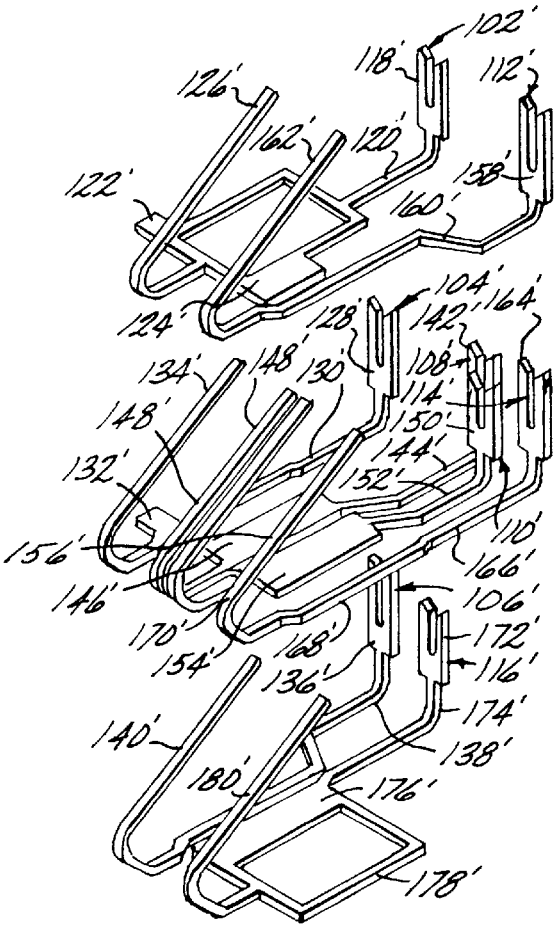
Figure 10C:
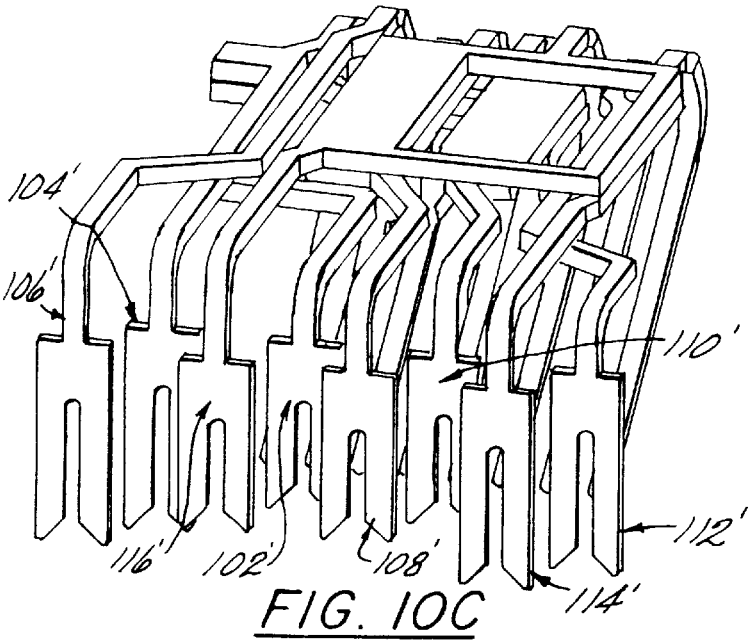
Figure 11A:
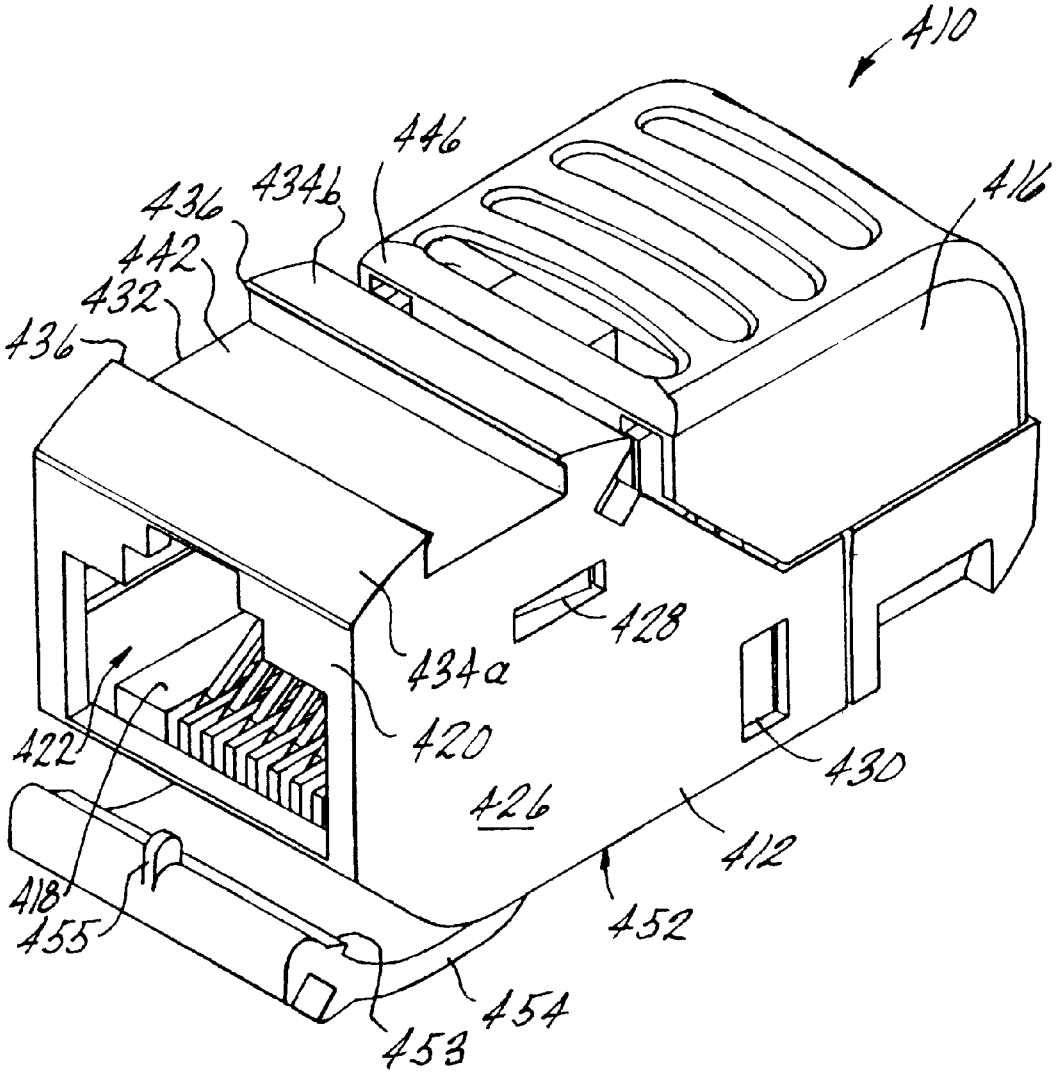
Figure 11B:
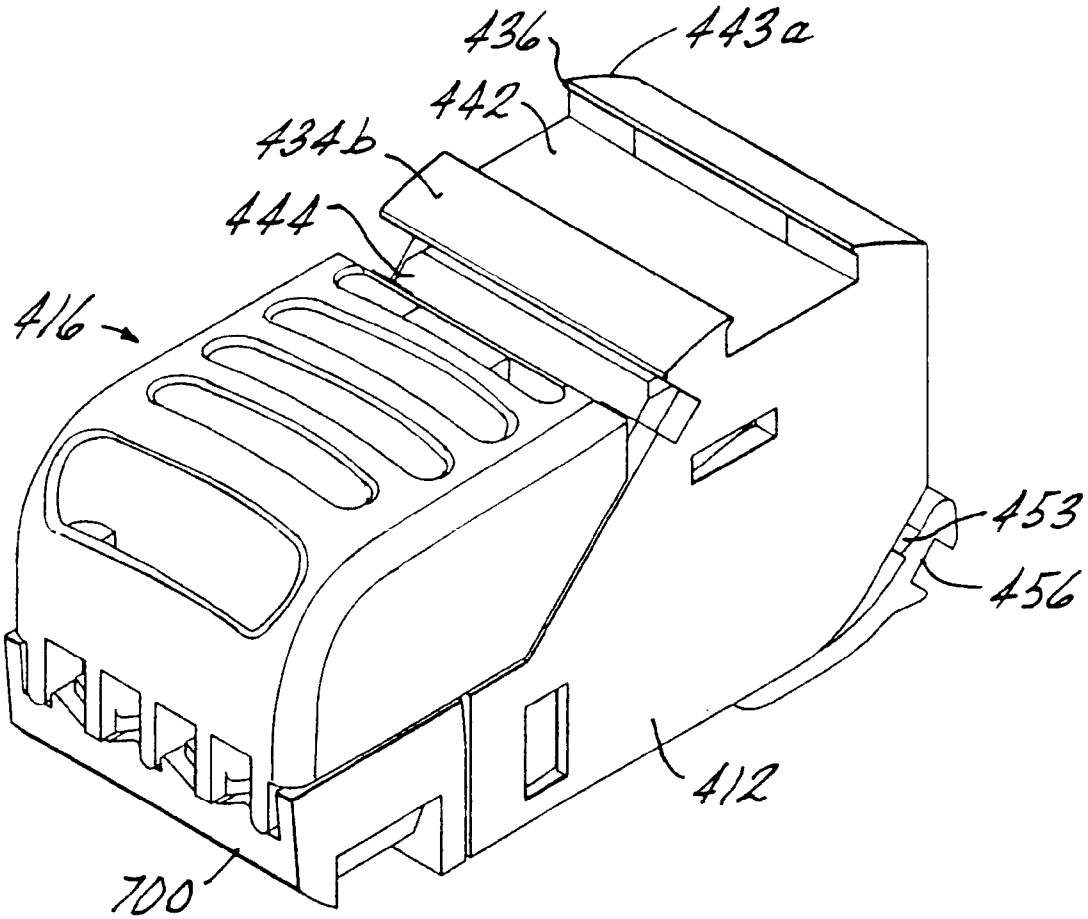
Figure 12A:
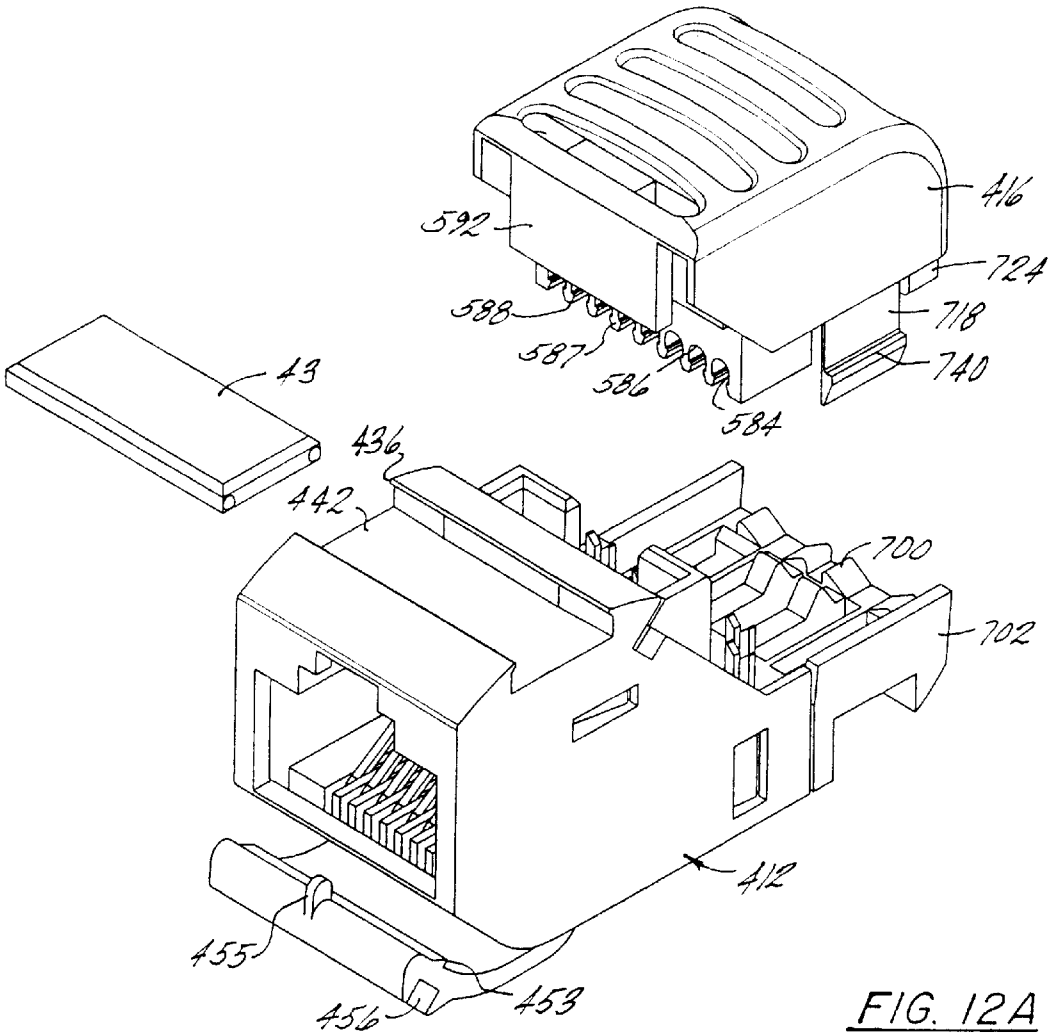
Figure 12B:
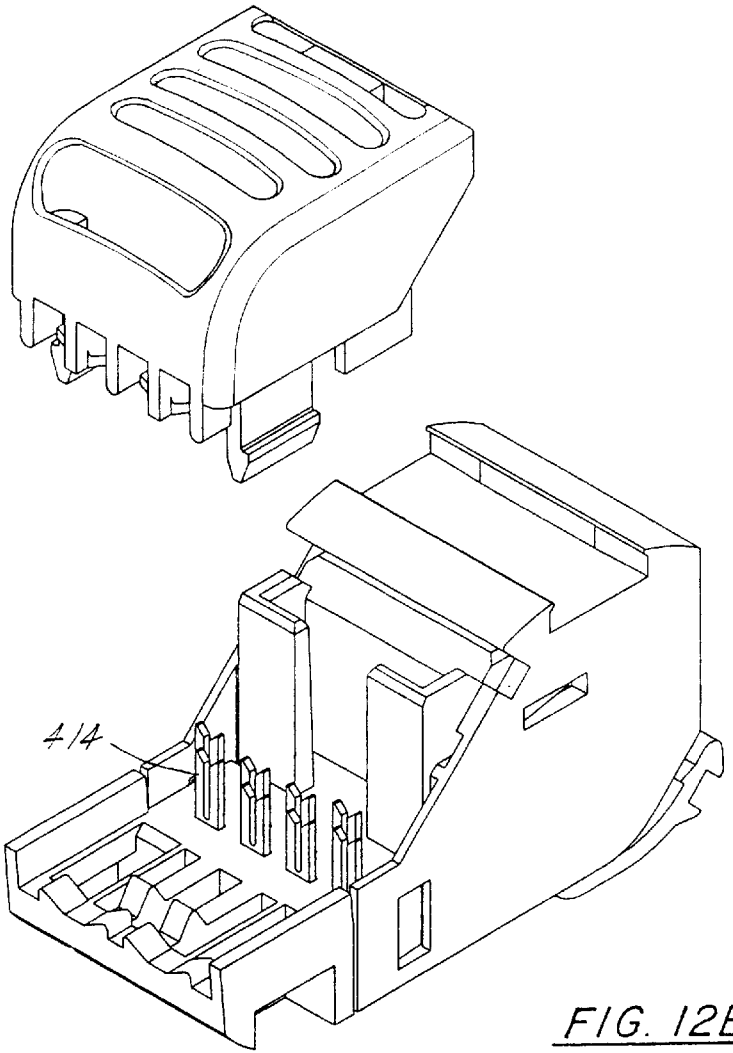
Figure 13A:
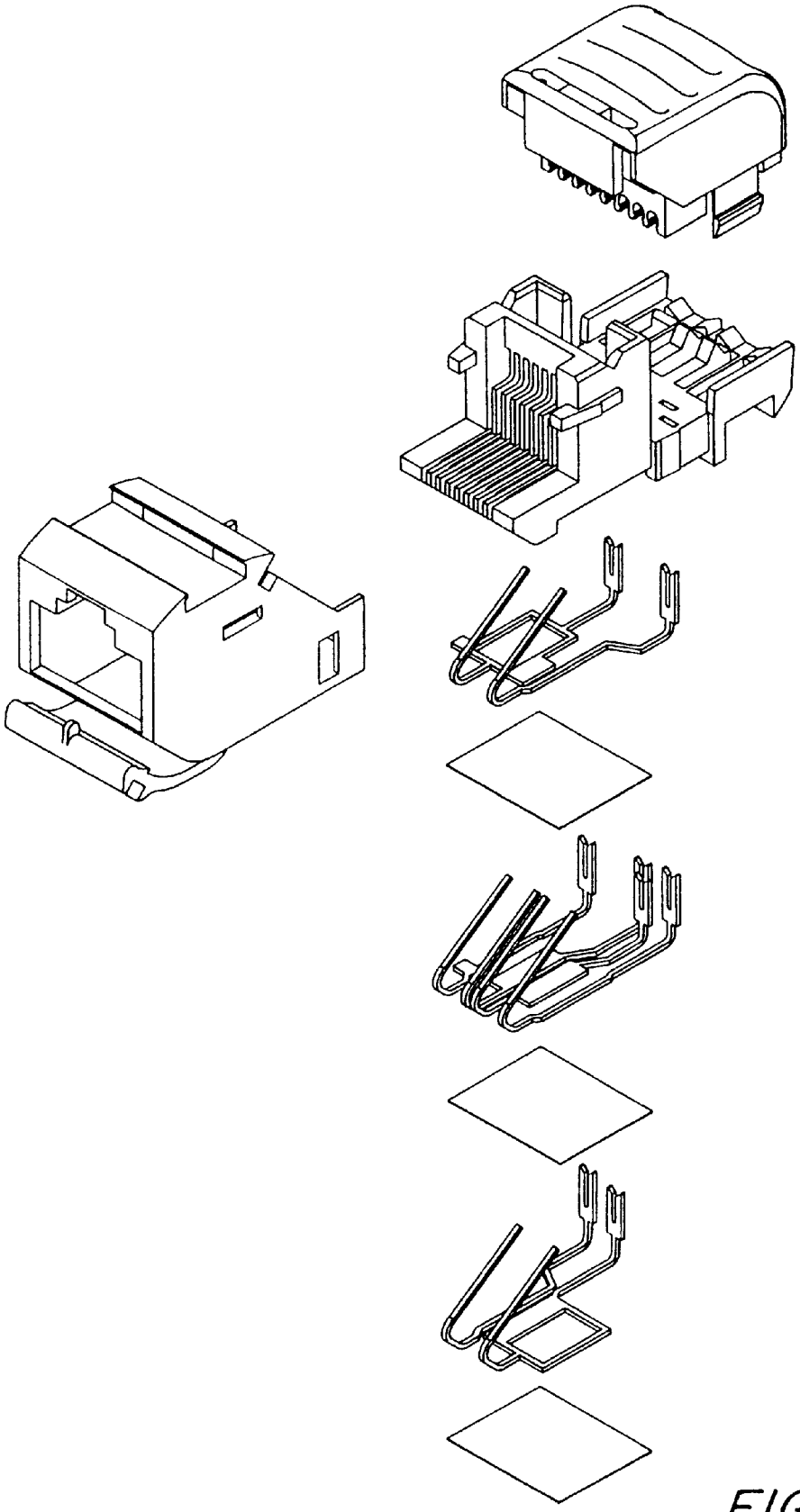
Figure 13B:
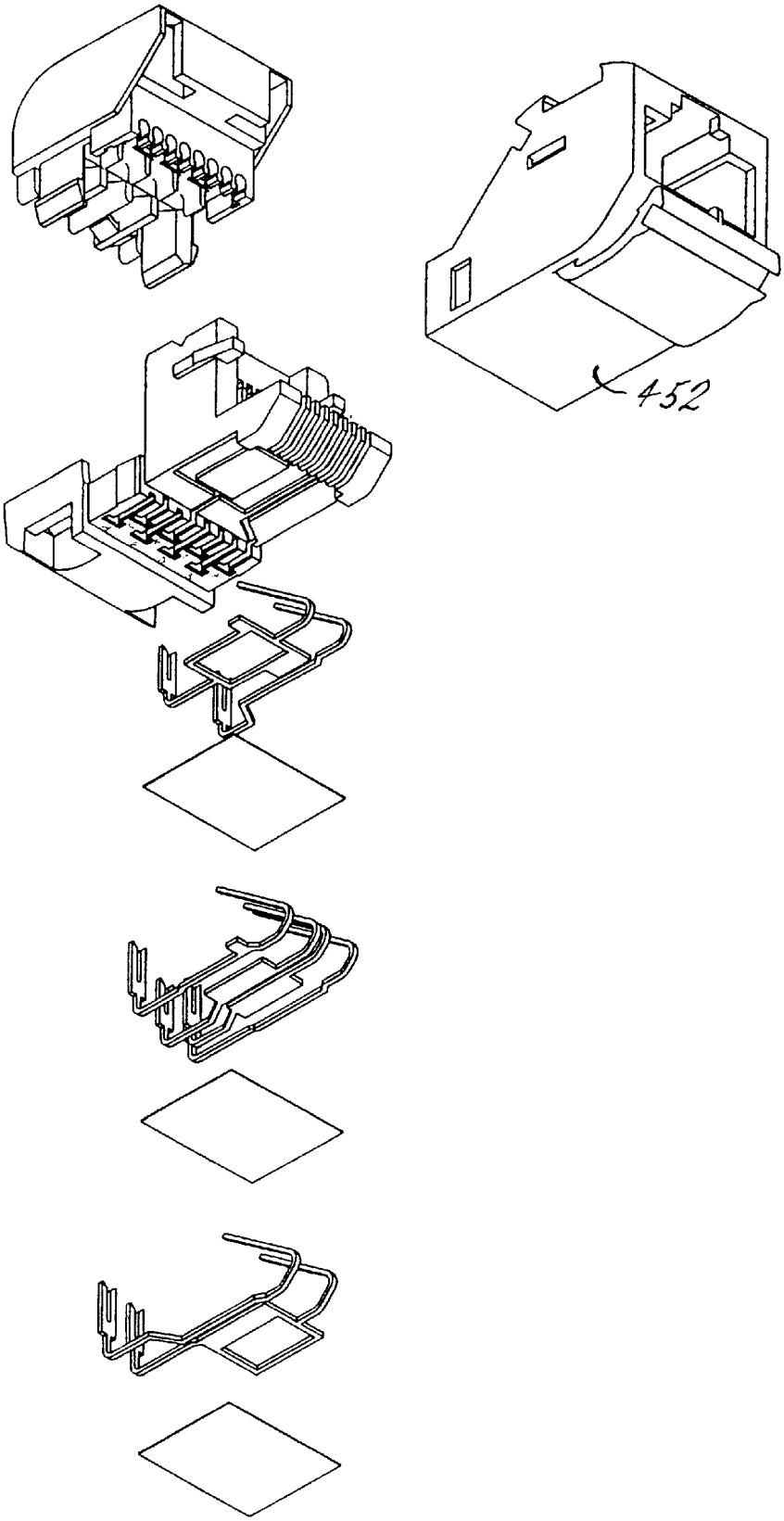

Referring to FIGS. 10A–C, in accordance with an alternate and preferred contact configuration. Contacts 14', comprise contacts 102', 104', 106', 108', 110', 112', 114' and 116'. Contact 102' comprises an insulation displacement terminal 118' connected by a lead 120' to plates 122' and 124' which are connected to a modular outlet terminal 126' (i.e., pin 6, R2 in accordance with T568A). Contact 104' comprises an insulation displacement terminal 128' connected by a lead 130' to a plate 132' which is connected to a modular outlet terminal 134' (i.e., pin 8, R4 in accordance with T568A). Contact 106' comprises an insulation displacement terminal 136' connected by a lead 138' to a modular outlet terminal 140' (i.e., pin 7, T4 in accordance with T568A). Contact 108' comprises an insulation displacement terminal 142' connected by a lead 144' to a plate 146' which is connected to a modular outlet terminal 148' (i.e., pin 5, T1 in accordance with T568A). Contact 110' comprises an insulation displacement terminal 150' connected by a lead 152' to a plate 154' which is connected to a modular outlet terminal 156' (i.e., pin 4, R1 in accordance with T568A). Contact 112' comprises an insulation displacement terminal 158 connected by a lead 160' to a modular outlet terminal 162' (i.e., pin 2, R3 in accordance with T568A). Contact 114' comprises an insulation displacement terminal 164' connected by a lead 166' to a plate 168' which is connected to a modular outlet terminal 170' (i.e., pin 1, T3 in accordance with T568A). Contact 116' comprises an insulation displacement terminal 172' connected by a lead 174' to plates 176' and 178' which are connected to a modular outlet terminal 180' (i.e., pin 3, T2 in accordance with T568A).

It is an important feature of the present invention, that plate 122' of contact 102' is disposed over plate 132' of contact 104' and plate 124' of contact 102' is disposed over plate 154' of contact 110', with a dielectric sheet (e.g., Mylar™ or Kapton™) disposed therebetween. According, capacitive coupling is induced or added between contact 102' (i.e., pin 6, R2 in accordance with T568A) and contact 104' (i.e., pin 8, R4 in accordance with T568A), and between contact 102' (i.e., pin 6, R2 in accordance with T568A) and contact 110' (i.e., pin 4, R1 in accordance with T568A). Further, plate 176' of contact 116' is disposed below plate 146' of contact 108' and plate 178' of contact 116' is disposed below plate 168' of contact 114', with a dielectric sheet (e.g., Mylar™ or Kapton™) disposed therebetween. According, capacitive coupling is induced or added between contact 116' (i.e., pin 3, T2 in accordance with T568A) and contact 108' (i.e., pin 5, T1 in accordance with T568A), and between contact 116' (i.e., pin 3, T2 in accordance with T568A) and contact 114' (i.e., pin 1, T3 in accordance with T568A).

As in the other embodiment, it is an important feature of the present invention that while the modular outlet terminals are positioned in accordance with a standard configuration, e.g., T568A, the insulation displacement terminals are configured to improve wiring termination. More specifically, sequential terminals 158' and 164' correspond to R3 and T3, respectively; sequential terminals 150' and 142' correspond to R1 and T1, respectively; sequential terminals 118' and 172' correspond to R2 and T2, respectively; and sequential terminals 128' and 136' correspond to R4 and T4, respectively. In standard T568A terminals wire pair T2 and R2 are split, i.e., not sequential, thereby requiring that at least this pair be partially untwisted at this termination. Maintaining the integrity of the twisted wire configuration is significant in high bandwidth applications, e.g., Category 5 or the emerging ATM standards. In accordance with this objective, the untwisting of conductors is to be minimized, whereby the termination configuration of the present invention aids in limiting this problem by eliminating the pair split when terminating. Furthermore, in this preferred embodiment not only are the corresponding T-R pairs kept together, the specific alternating T-R sequence is maintained consistently on all four pairs at the input end. The input sequence is R3 T3 R1 T1 R2 T2 R4 T4. This has the advantage of not having T1 and T2 adjacent to each other. Both of these wires are white and could lead to confusion during installation if they were adjacent. This is a benefit to the industry.

Referring to FIGS. 11A–15B, another embodiment of the mechanical structure for supporting the electronic members of the modular jack 410 of the invention is illustrated. A connector housing 412 is adapted to receive a contact carrier 418 which supports a plurality of contacts 414. A termination cap 416 is then mated to carrier 418 for terminating, protecting and mechanically fastening a plurality of wires at one end of contacts 414.

Connector housing 412 comprises a front panel 420 having a standard modular jack opening 422 therein. A pair of side panels 424 and 426 depend rearwardly from panel 420 on either side thereof and generally parallel to one another. Each panel 424 and 426 includes mounting holes 28 and 30 therein. A top panel 432 extends rearwardly from panel 20 joining upper edges of panels 424 and 426. Panel 432 includes slope members 434*a* and 434*b* which increase the thickness of panel 432 and terminate in a pair of overhangs 436. Members 434 and overhangs 436 in combination define a slot 442 for slidingly receiving an icon or insert 43. (the icons are illustrated in FIGS. 8A–B in conjunction with the description of a previous embodiment and are equally applicable here). Rearward of slot 442 is a panel receiving slot 444 which is defined by the rearward of extreme member 434*b*, chamfer 446 (on the cap 416 which is more fully discussed hereinafter) and by removal of material from side panels 424 and 426. Housing 412 further includes a bottom panel 452, which is disposed opposite top panel 432 and which also extends rearwardly from front panel 420. Bottom panel 452 is curved upwardly at a front end thereof to meet front panel 420. Resilient member 454 depends downwardly of panel 452 and then approximately follows the contours of 452 until it terminates in a panel receiving slot 456 at a front end thereof which slot is adapted to engage a wall panel, plate or the like (see FIG. 9 for a representative plate). Depending upwardly from a front edge of member 454 is nub 455 to guide the insert of door 870 (more fully discussed hereinafter). Also depending upwardly from member 454 is rib 453 which engages and retains the door.

Figure 14A:
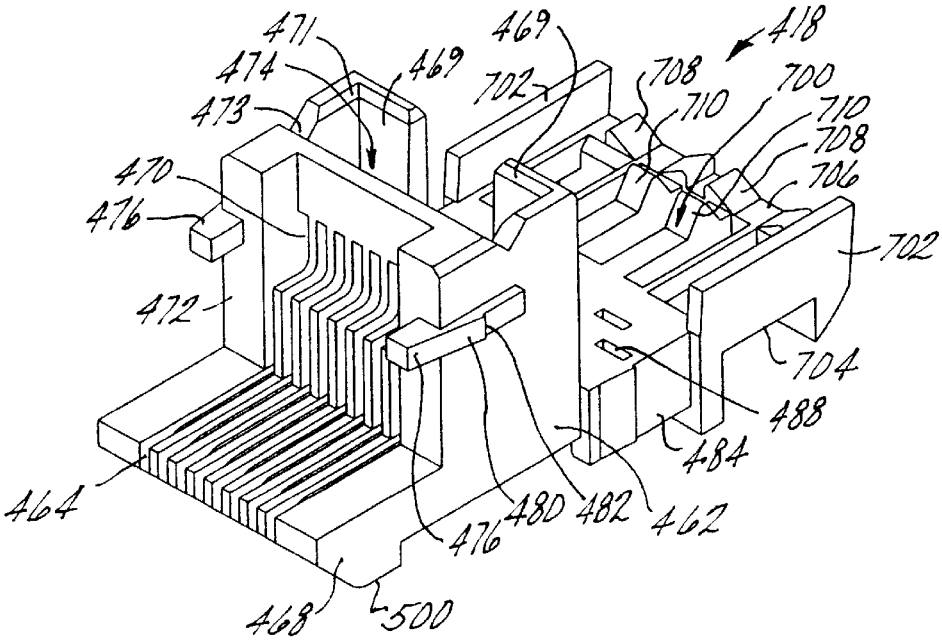
Figure 14B:
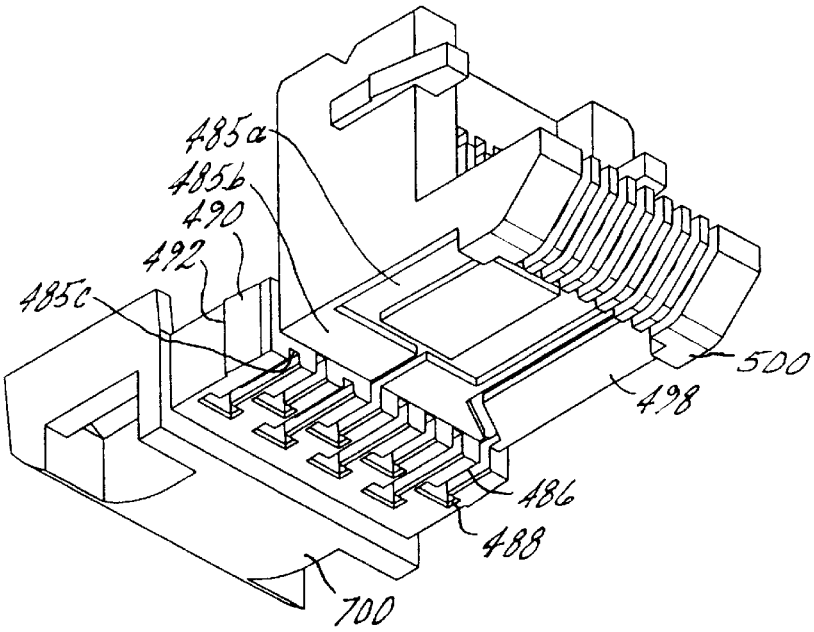
Figure 14C:
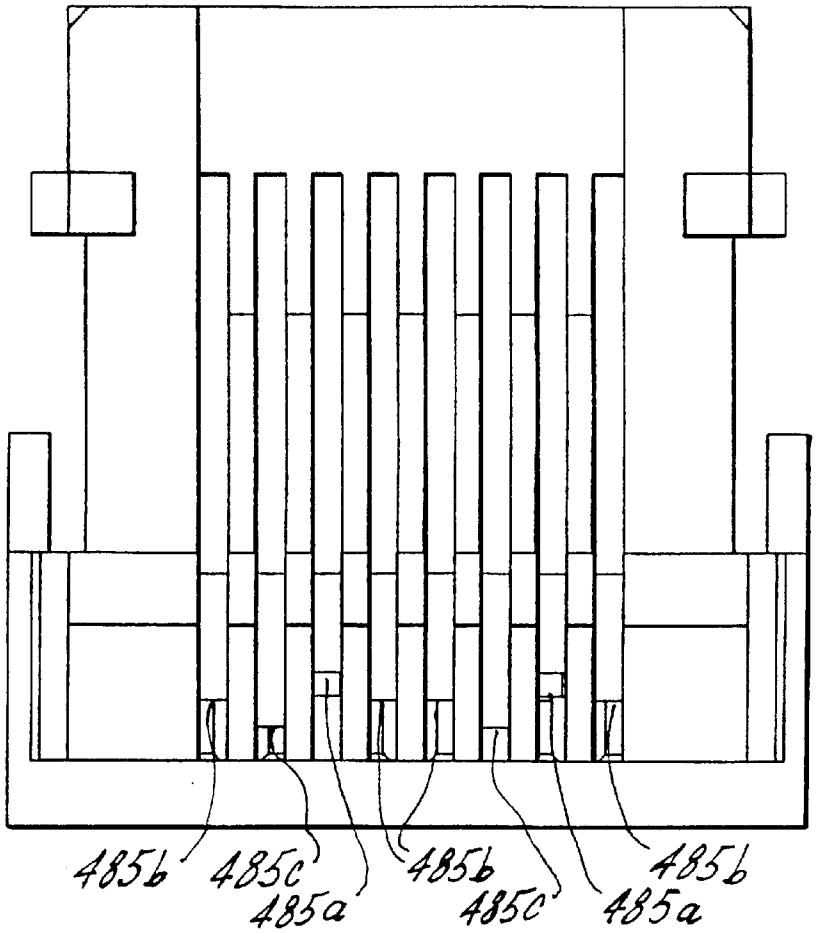
FIG. 14C is a front plan view of the carrier illustrating differing depths of slots.

As illustrated in FIGS. 13A, 13B, 14A and 14B, contact carrier 418 comprises a front generally L-shaped portion 462 which is receptive to a standard modular outlet and includes a plurality of slots 464 therein for receiving contacts 414. Slots 464 are defined at the front end of the lower leg portion 468 and in a partial channel 470 in the front surface of upper leg portion 472. A second channel 474 is defined in the back surface of upper leg portion 472. Channel 474 is defined by boxed extensions 469 having chamfered edges 471 on a top edge thereof and further include notches 473 which are coextensive with panel receiving slot 444 in housing 412 when housing and carrier 418 are assembled. The front end of lower leg portion 468 is inclined to cooperate with the curved front end of panel 452 when contact carrier 418 is inserted in connector housing 412. To retain contact carrier 418 within connector housing 412 arms 476, 478 are provided. Arms 476 and 478 each include an inclined surface 480 to aid in the insertion of contact carrier 418 in connector housing 412 from the rear thereof and retaining edges 482. Retaining edges 482 engage and are received in holes 428 of side panels 424 and 426. A termination block portion 484 depends rearwardly from the lower end of leg portion 472. Block portion 484 includes a plurality of slots 486 at the lower portion thereof for receiving contacts 414. The lower portion itself comprises three distinct surfaces on three distinct levels for positioning of contacts. The surfaces are illustrated in FIGS. 14*b* and 14*c* and are identified by numerals 485*a*, 485*b*, and 485*c*. Each of the surfaces allow for positioning of desired contacts. Furthermore the surfaces, because they are molded into the carrier itself provide mechanical stability for the individual contacts in each of the surfaces on which they are positioned. It should be understood that the slots 464 also include three different levels of surfaces 485*a*, 485*b* and 485*c* which can be viewed in FIG. 14*c*. Each slot 486 communicates with an opening 488 which extends through block portion 484, where corresponding contacts 414 pass through. A ramped surface 490 defining a retaining ledge 492 is defined at each side 494, 496 of block portion 484. A recess 498 is defined between block portion 484 and a downward extension 500 of lower leg portion 468. Recess 498 receives portions of contacts 414 when they are installed on contact carrier 418.

Depending rearwardly from block 484 is cable trap 700. Trap 700 includes side walls 702. Side walls 702 further include undercut edges 704 to retain the termination cap discussed hereunder. Body 706 of trap 700 which is disposed between sidewalls 702 includes a plurality, and preferably four protrusions 708 oriented on a rear section thereof. These protrusions are adapted to meet tabs on the termination cap, supporting them, to prevent breaking thereof if the cable is pulled. Further wire retention is provided by protuberances 710. The protuberances provide a form of mild retention or strain relief only as to the central two pairs as will be appreciated by one of skill in the art. Mild strain relief is provided because space was available and not because such relief is necessary for the invention.

Figure 15B:
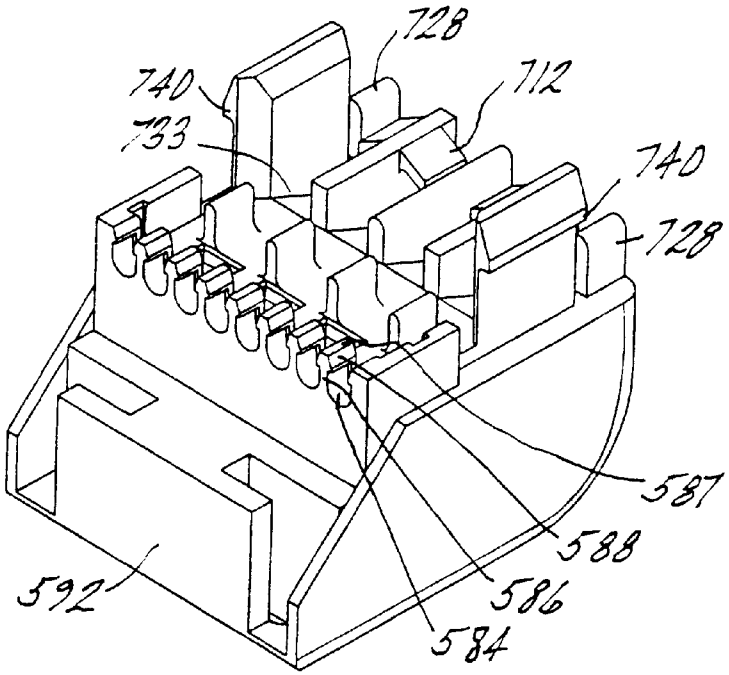
Figure 15A:
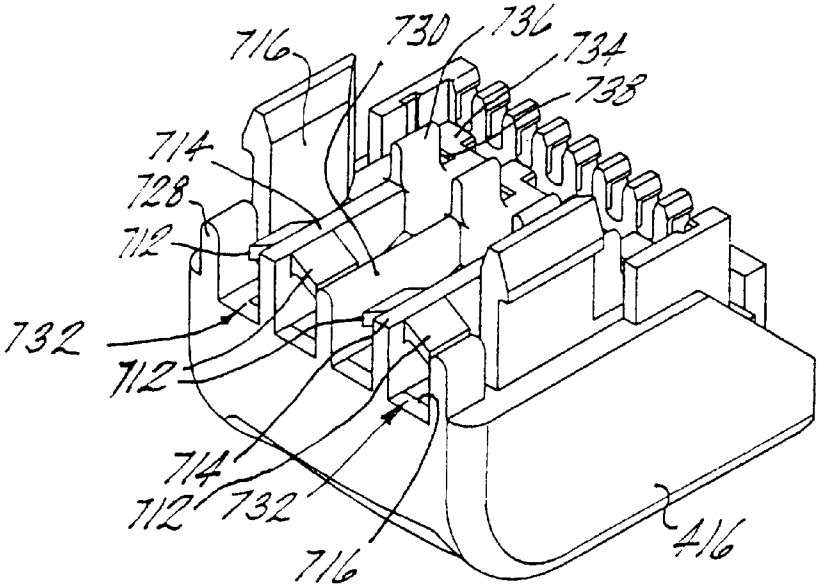

In communication with the members discussed above are several features of the termination cap 416 of this embodiment. As noted above, the protrusions 708 are positioned immediately subjacently to the tabs 712 of cap 416. It should be noted that because the tabs 712 are intended to be able to deflect in order to pass a twisted pair past them, they can be broken by rough handling. In order to alleviate the possibility of breakage, protrusions 708 support the same when cap 416 is engaged with carrier 418. The tabs 712 themselves are dependent from walls 714 which extend downwardly from a lower surface 716 of cap 416. Discrete areas of lower surface 716, in combination with latches 718, support tabs 728, and center wall 730 define grooves 732 as illustrated in FIG. 15A. Each of the four grooves 732 is configured to accept one twisted pair for passage through to the plurality of wire retaining slots 584 defined by teeth 586. Teeth 586 each include retaining head 587 narrower at the extremity and wider nearer the body of each tooth 586 as shown. This arrangement provides a pathway for each untwisted wire the pathway being wider than the conductor itself and narrower than the outside dimension of the insulation. Thus, some retention is provided. It should be noted that for greater ease of insertion of each wire into each slot 584 the head 587 includes angled surfaces 588. In order to assist the entry of wires into slots 584, each twisted pair is ramped up from grooves 732 on ramps 733 to second lower surface 734. Second lower surface 734 supports separation lugs 736 and also provides IDC receptacles 738 for receiving IDC's after they are pressed onto individual wires. It is preferable that the individual wires are not untwisted until beyond lugs 736 thus making the smallest untwisted sections possible. Lugs 736 are four in number and function to separate four passageways for one twisted pair each. After the wires are untwisted and laced into the appropriate slots, they are consequently positioned over IDC receptacles 738 which places them over the desired IDC's extending upwardly from contact carrier 418.

As in the hereinbefore described embodiments the contacts in this embodiment provide the same benefits and are arranged in substantially the same way.

It should be noted that one of the benefits conferred by the arrangement of the invention is that mass termination is rendered easier to the extent that the amount of pressure required to so terminate the wires is reduced. The reduced pressure is occasioned by a staggered height of the IDCs. Staggering the height causes a few wires to terminate at a time while the termination cap 416 is being urged into engagement with the jack 410.

Once the wires have been inserted into the slots of the termination cap as set forth above, the wires are cut if they extend beyond the slots and the wires are terminated onto respective insulation displacement terminals. The wires are terminated by inserting block 592 into channel 474 of contact carrier 418, thereby aligning the termination cap 416 with the contact carrier 418, and pushing downwardly until the insulation displacement terminals displace the insulation on the wires and electrically connect with the conductive wire, (i.e., a mass termination). Termination cap 416 is retained on contact carrier 418 by latch lips 740 the latches of which are subsequently defeatable by conventional means if desired.

Referring to the inserts, it will be appreciated that the mounting thereof is identical to the forgoing embodiment.

Figure 18:
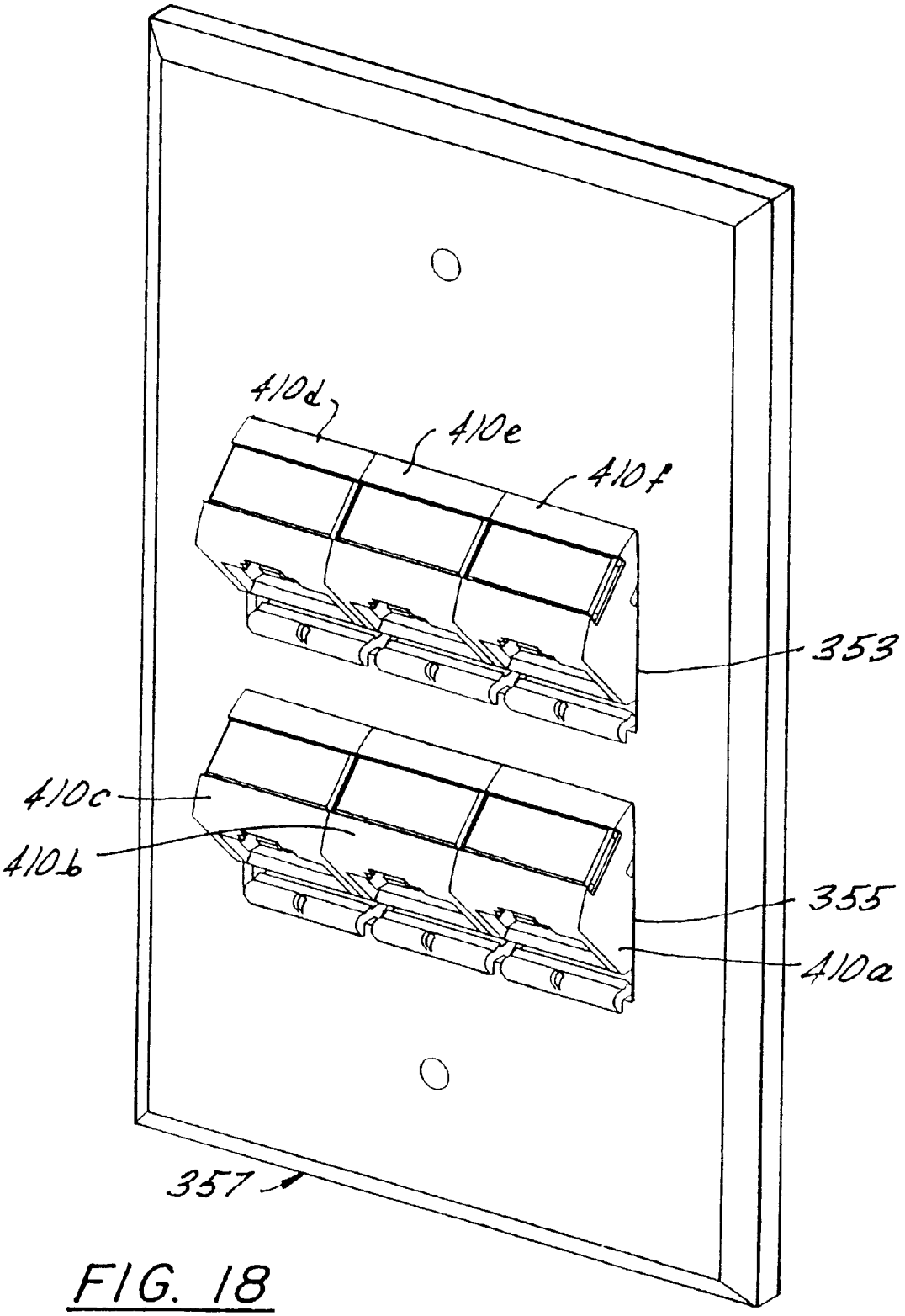
FIG. 18 is a front perspective view of six of the modular outlets of FIGS. 2A and B inserted in a wall plate in accordance with the present invention.

Referring to FIG. 18, six modular outlets 10*a*–10*f* are shown installed (in an side stackable manner) in corresponding openings 353, 355 of a wall plate 357. Slots 444 and 458 of each of the modular outlets receive corresponding edges of the wall plate at the openings. As is clearly shown in this figure, the modular outlets provide for a gravity feed thereto, the advantages of which are well know, see for example, U.S. Pat. No. 5,362,254 to Siemon et al., which is incorporated herein by reference. It is important to note that the jacks of the invention may be inserted either from the front or rear of the plate to render installation an easier affair.

As in the other embodiment, it is an important feature of the present invention that while the modular outlet terminals are positioned in accordance with a standard configuration, e.g., T568A, the insulation displacement terminals are configured to improve wiring termination.

Figure 16A:
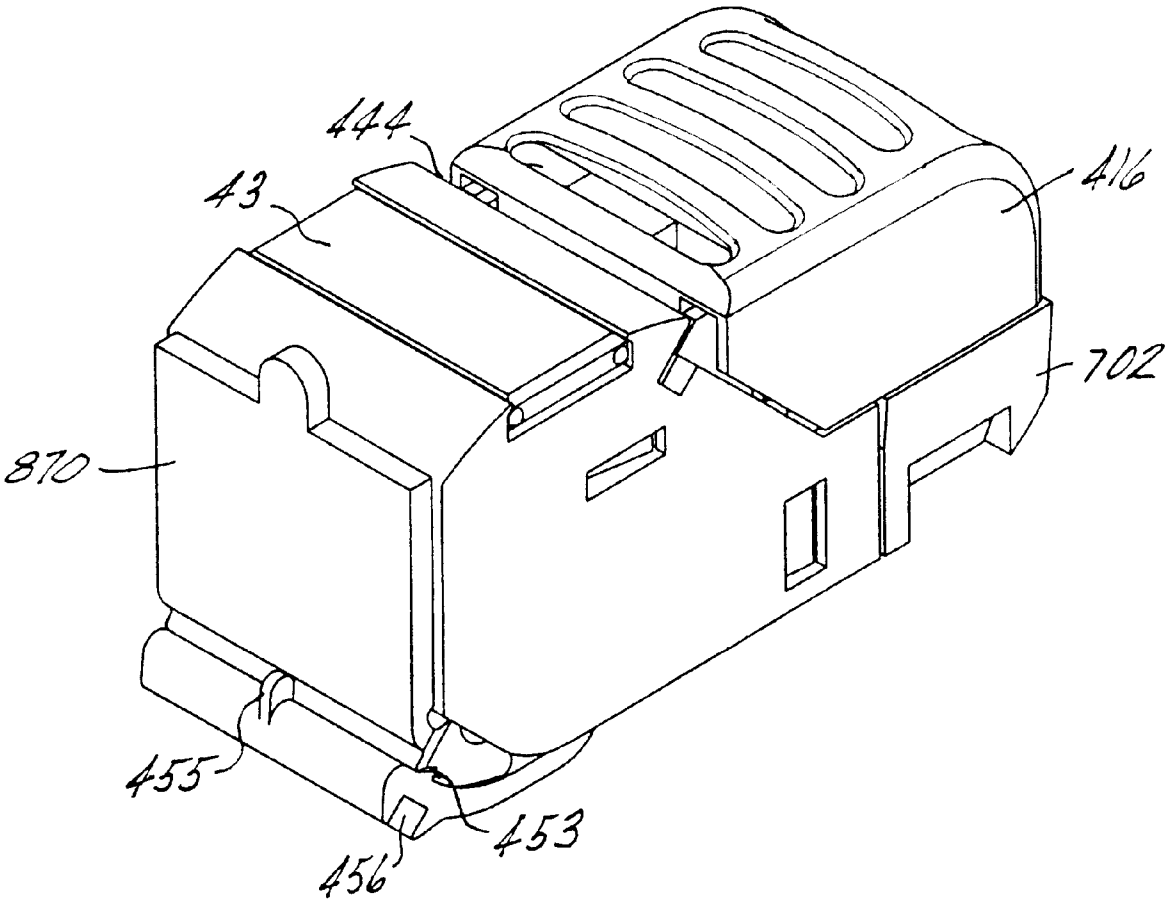
Figure 16B:
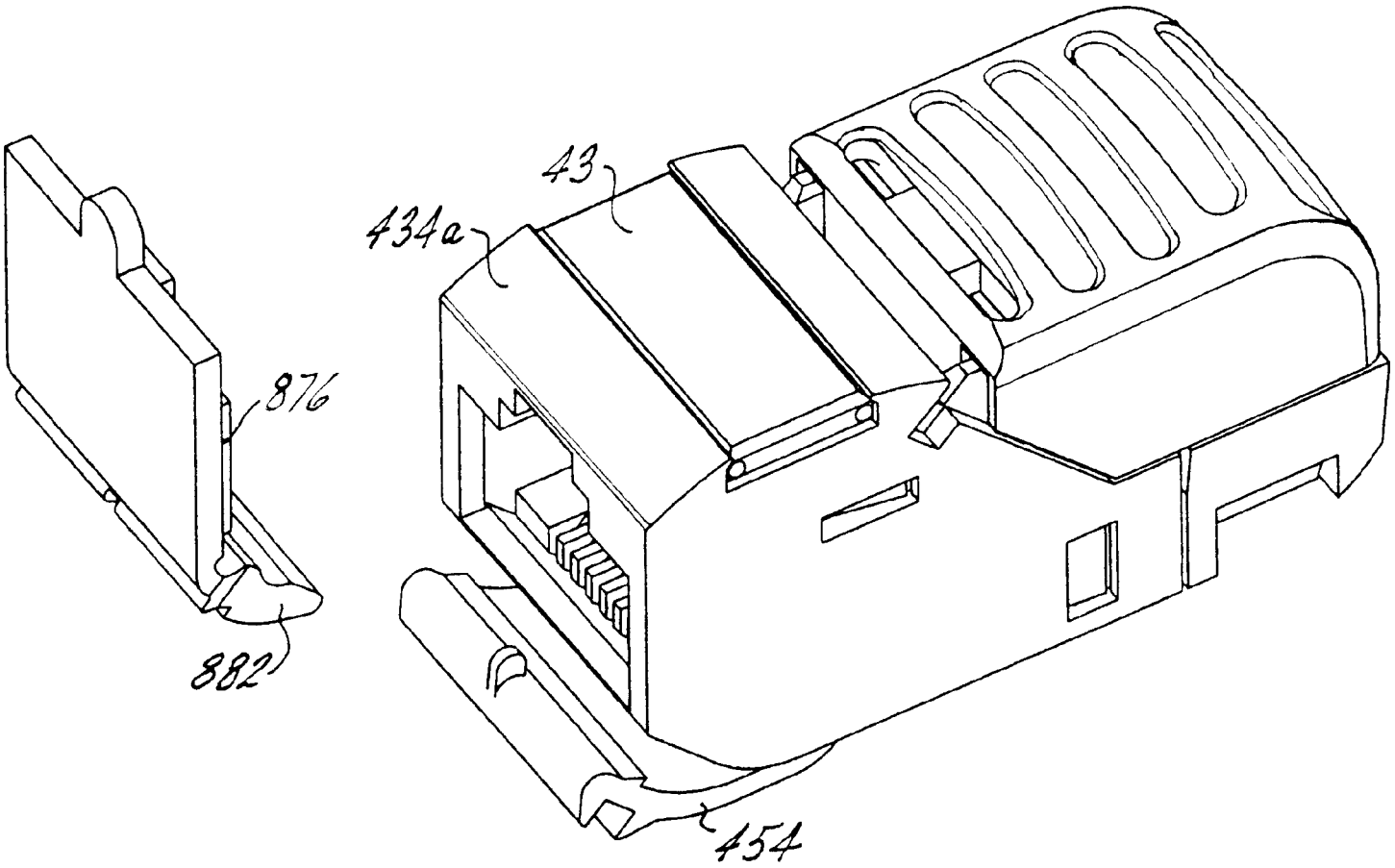
Figure 17C:
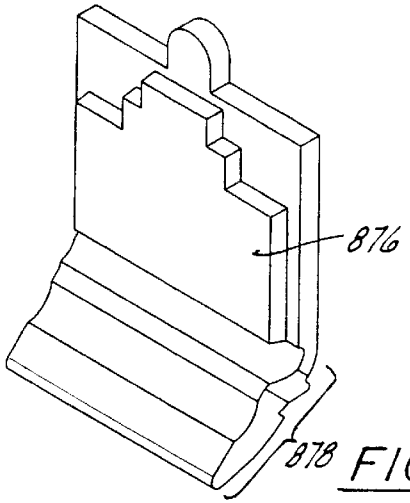
FIGS. 17A–D show various views of the doors of the invention.
Figure 17B:
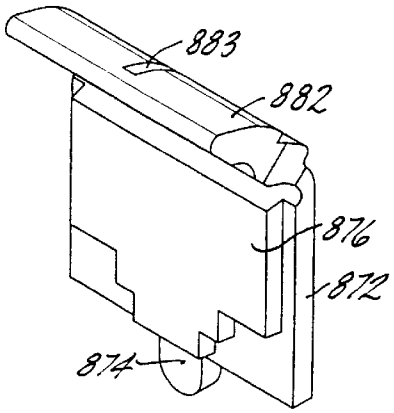
Figure 17A:
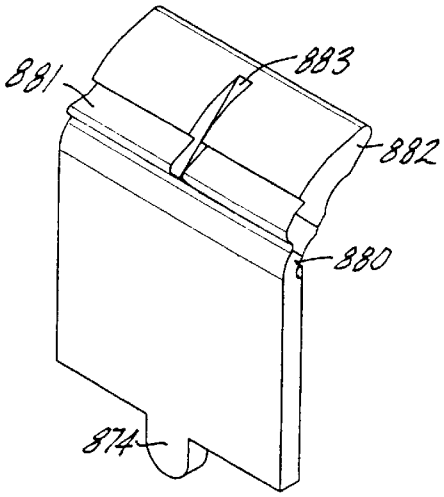
Figure 17D:
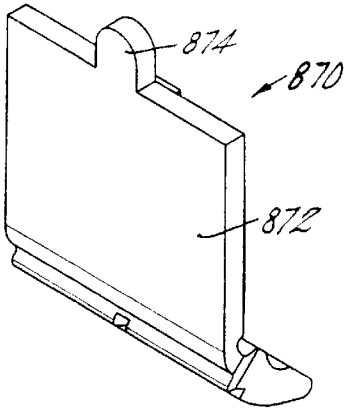

Also disclosed with respect to this outlet is a resilient door for the modular plug opening. FIG. 16A illustrates the entire assembly with the door 870 in place whereas FIG. 16B removes the door for closer inspection.

Referring to FIGS. 17A–D, door 870 includes plate 872 having pull tab 874 extending from one edge thereof and opening plug 876 protruding from a rear surface thereof. Oppositely disposed on said plate from said tab is hinged attachment member 878 which is engageable between the bottom panel and the resilient member of the housing 418. Hinged attachment member 878 includes narrowed band 880 extending laterally across member 878 and immediately adjacent plate 872. Band 880 renders door 870 easily operable. Member 878 further includes wedge 882 connected to band 880 and which communicates with the area defined between bottom panel 452 and resilient member 454. Depression 881 is intended to engage rib 453 on member 454. Channel 883 is provided to allow member 878 to align with nub 455 when being inserted. Door 870 is constructed of a deformable material and preferably of neoprene material. The door must be inserted into the housing only after the outlet is inserted into the wall plate. Otherwise because of the resistance of the door the resilient member 454 will be prevented from deforming sufficiently to enable the outlet to be inserted into the plate.

Figure 19:
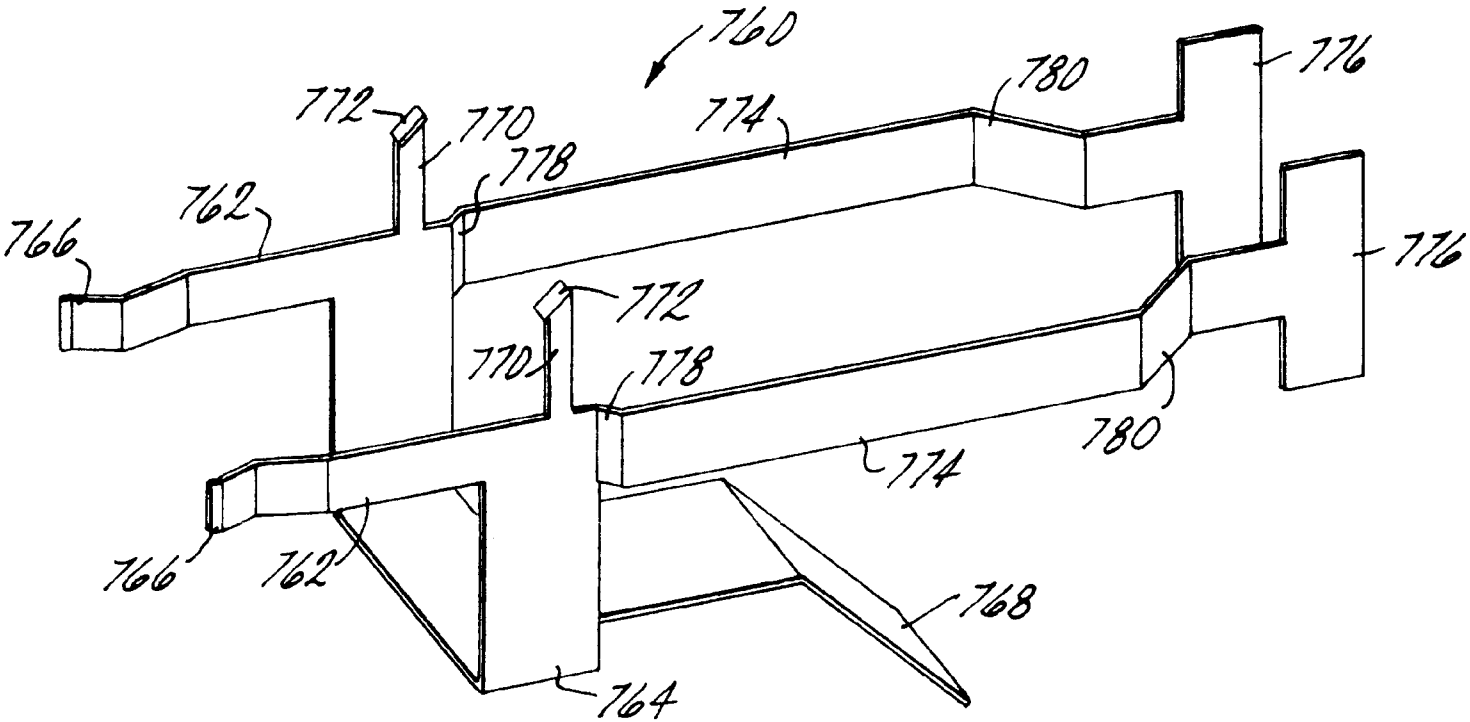
FIG. 19 is a perspective view of the shield for the embodiments described herein.

Referring to FIG. 19, a shield 760 is illustrated in an extracted form from the contact carrier 418 illustrated in this disclosure. The shield is employable with all of the jacks presented herein, if desired, by snapping the shield in the desired connection. The shield provides a single continuous low impedance connection for the incoming cable shield and outgoing cable shield, not shown. As will be appreciated by those skilled in the art a low impedance path which avoids the current carrying drawbacks of having a multiple connection and, therefore, higher impedance pathway.

The shield of the invention includes a pair of fingers 762 extending from a frame 764 and which are the contact points for the shield contacts on the plug to be inserted in the jack of the invention. In order to create a solid connection, finger ends 766 include an inwardly projecting bend portion which will act to tighten a subsequent connection. Frame 764 further includes grounding tab 768 which may optionally be connected to a grounded housing, not shown. Tab 768 is configured for a standard female terminal, not shown. Alternatively, assuming grounding is desired, uprights 770 having angled ends 772 extend from a top edge of frame 764 to provide grounding on a grounded face plate. In this alternative, ends 772 nestle in notches 473 on carrier 418 and contact the face plate when the jack is inserted into the same.

The rear edge of frame 764 supports rearwardly extending members 774 which terminate rearwardly in end plates 776. To provide sufficient room for contact carrier 418 which when engaged is located between members 774, each member contains two bend areas. Forward bend area 778 widens the dimension between members 774 and rearward bend area 780 narrows the dimension to substantially the same dimension as frame 764. Plates 776 define the contact area for the incoming cable shield.

Figure 20:
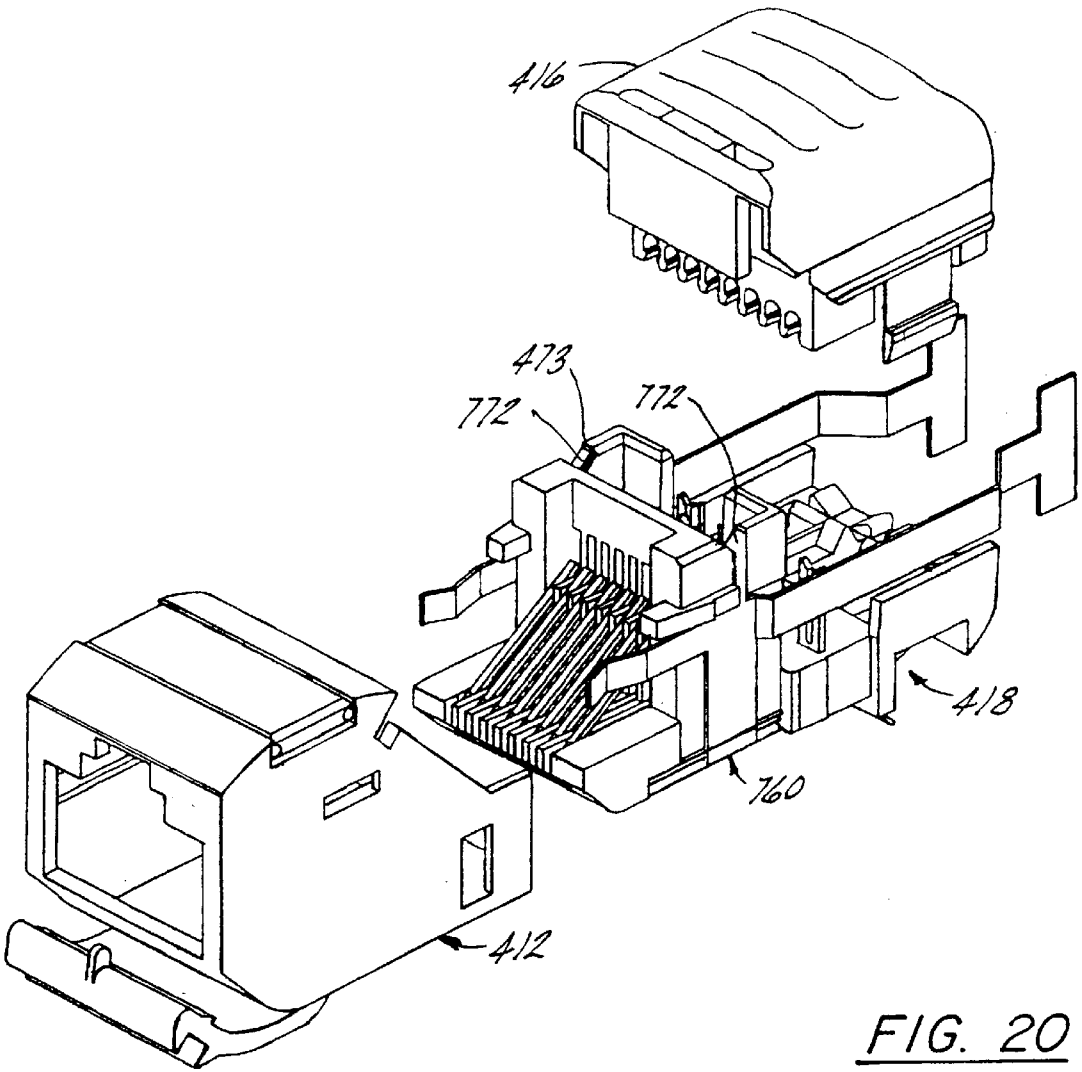
FIG. 20 is a partially exploded perspective view of one embodiment of the invention illustrating the shield in place.
Figure 21:
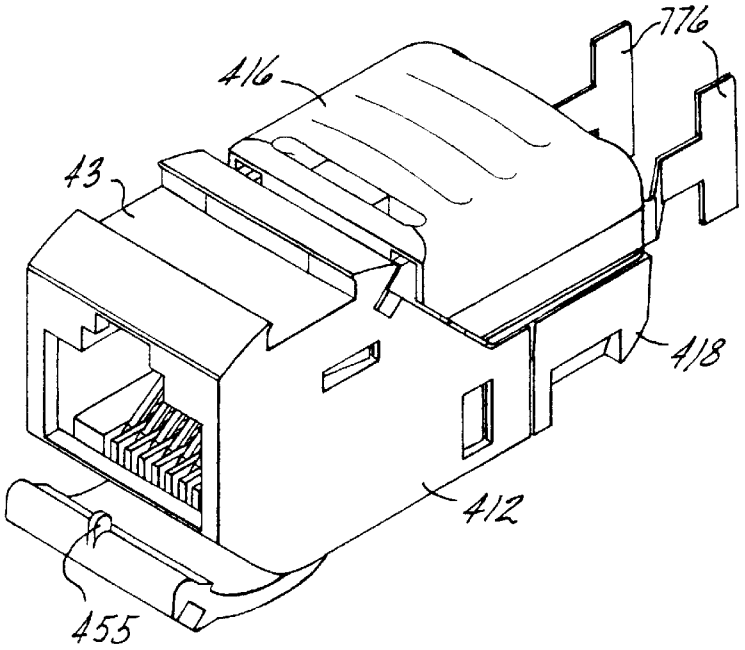
FIG. 21 is a top oriented perspective view of one embodiment of the invention with the shield in place.
Figure 22:
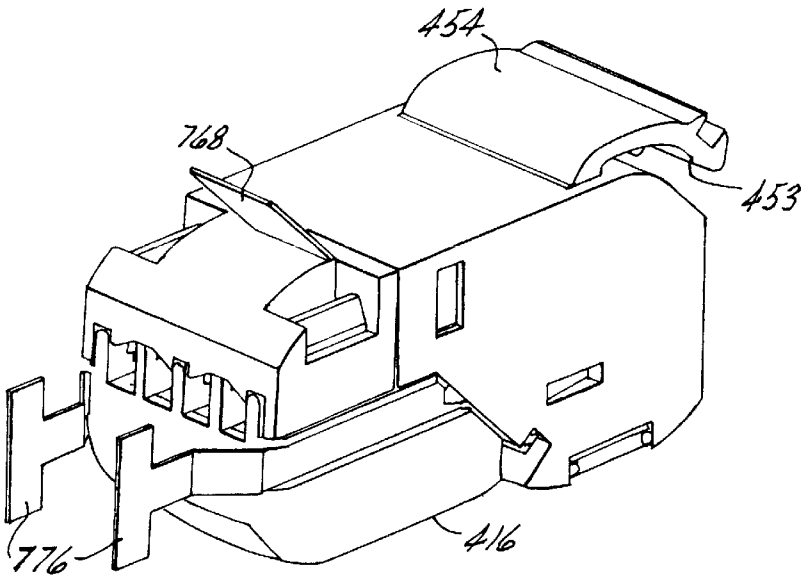
FIG. 22 is a bottom oriented perspective view of FIG. 21.

Referring to FIG. 20, a partially exploded view of the invention with the shield in place. Positioned in this manner, ends 772 are visible in notches 473. Perusal of the figure will provide a complete understanding of the engagement of shield 760 with carrier 418. FIGS. 21 and 22 provide views where the entire outlet is assembled.

Figure 24:
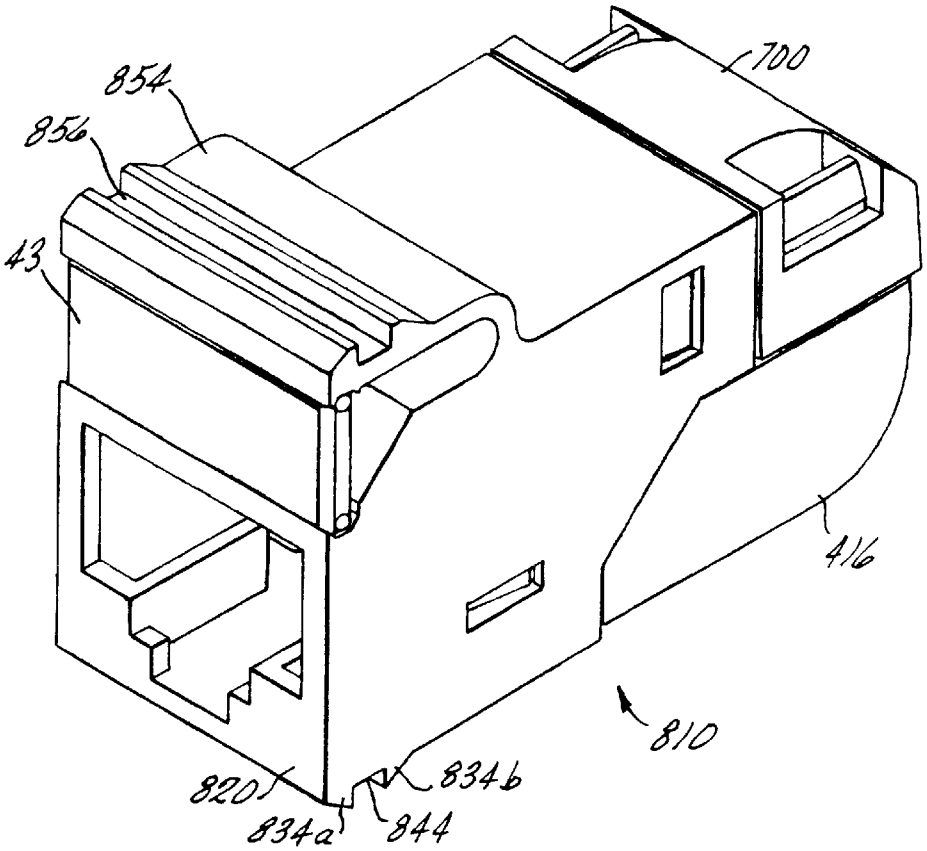
FIG. 24 is a perspective view of the embodiment of FIG. 23 removed from the wall.
Figure 23:
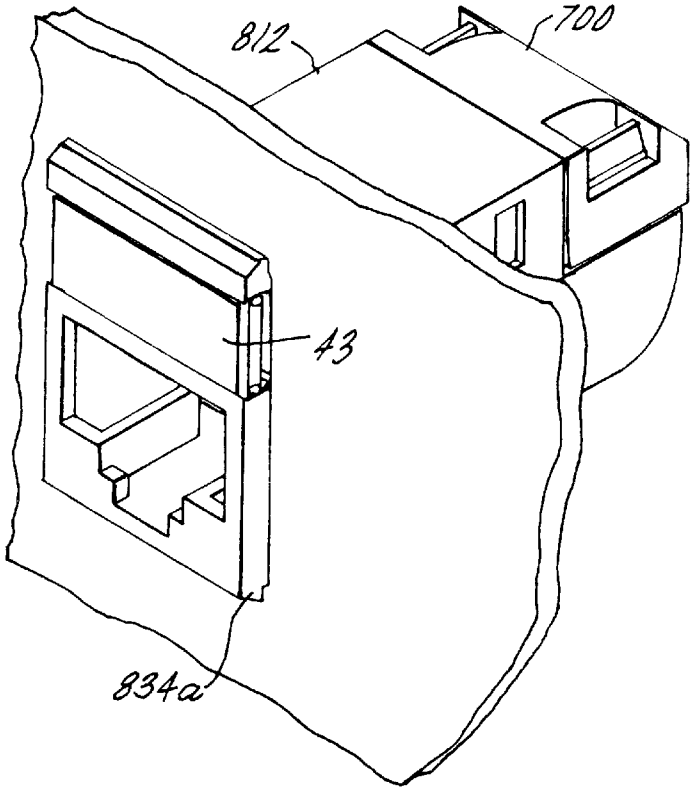
FIG. 23 is a perspective view of the straight embodiment of the invention illustrated in a broken away wall section.
Figure 25:
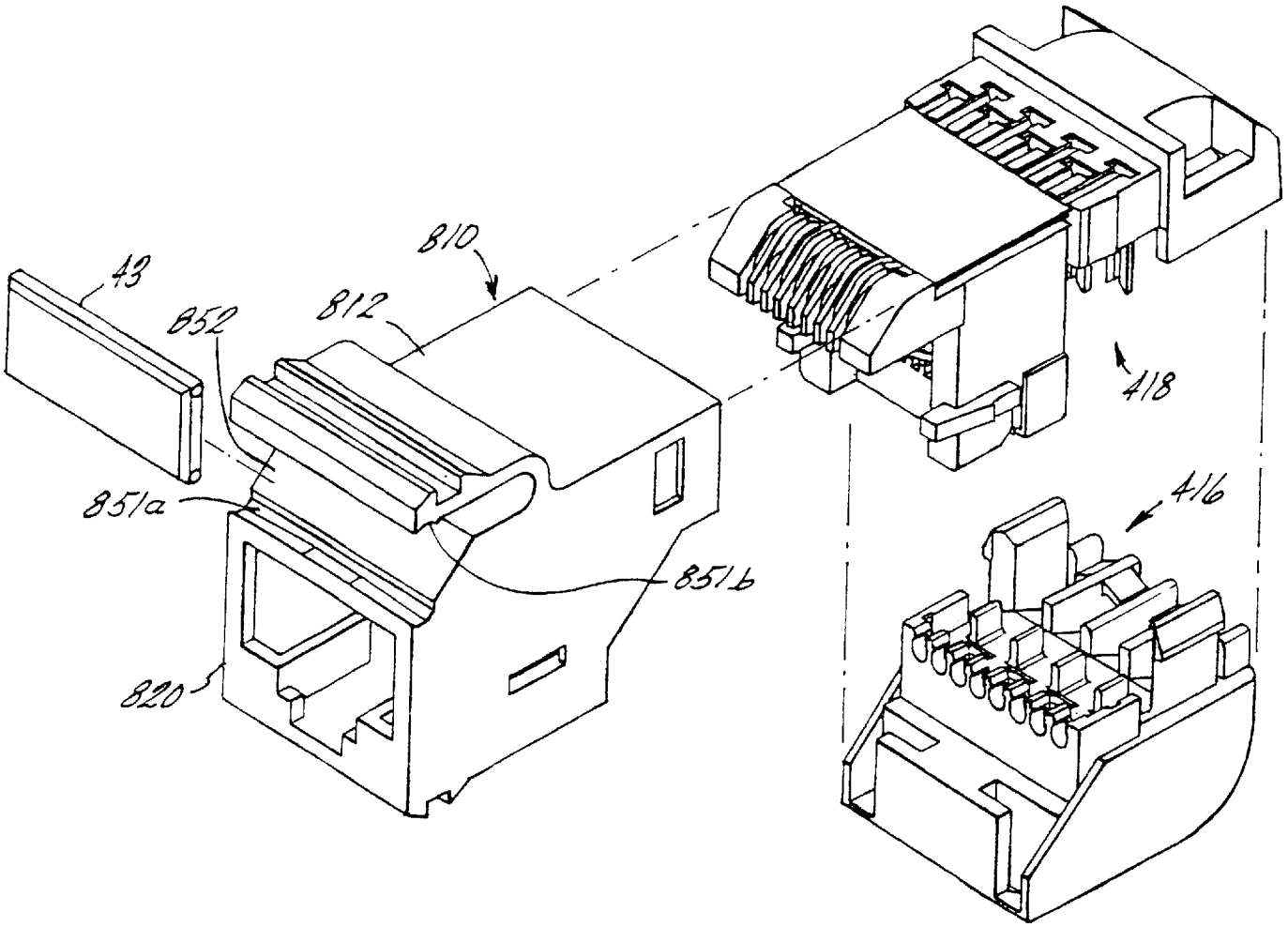
FIG. 25 is a perspective partially exploded view of the straight embodiment.

In yet another embodiment of the invention, referring to FIGS. 23–25, a straight outlet is illustrated. The straight outlet 810 employs the contact carrier 418 and the termination cap 416 of the previous embodiment but utilizes a housing 812 constructed somewhat differently than those previously discussed.

In general, housing 812 is of similar configuration, having a front panel 820 with a standard modular jack opening 822 therein and two side panels 824 and 826 which define holes 828 and 830. Top panel 832, bottom panel 852 differ in structure and orientation from the 412 embodiment. For clarity of drawings all of the parts of this embodiment employ identical suffix numerals but it should be appreciated that the whole outlet 810 is used upside down from the previous embodiments.

Top panel 832 includes angled stops 834A and 834B which ramp toward one another and provide opposed stop surfaces defining a panel receiving slot 844. Slot 844 is positioned much more closely to front panel 820 than slot 444 is to panel 420 in the previous embodiment because the outlet 810 is not intended to provide gravity feed.

Bottom panel 852 is angled upward to meet front panel 820 similarly to panel 452 but adjacent the interface between panel 852 and 820 an icon groove 851A is disposed and is coplanar with icon groove 851B disposed upon resilient member 854 depending from bottom panel 852. As with dependent resilient member 454, member 854 includes panel receiving slot 856. It will be appreciated by those skilled in the art that once panel receiving slot 844 and panel receiving slot 856 are engaged with a panel, the introduction of icon 43 into icon grooves 851A and 851B prevents deflection of member 854 thus locking the outlet into the panel. The outlet then cannot be removed without first removing the icon.

It is important to understand that each of the embodiments whether shielded or not, desired or not are side stackable in a single opening composed of multiples of an industry standard size. This provides space efficiency thus increasing the aesthetic appeal of a multiple outlet wall mount and meeting the high outlet-density demands of certain applications. A wall plate opening may have a range of widths to accommodate a desired number of outlets.

Moreover, all of the embodiments herein are configured for engagement with the wall plate from either front or rear which increases connection options and avoids the common drawback of connection from the rear of the plate only to require that all the cables be "stuffed" into the junction box for the plate to be secured to the wall.

Figure 26:
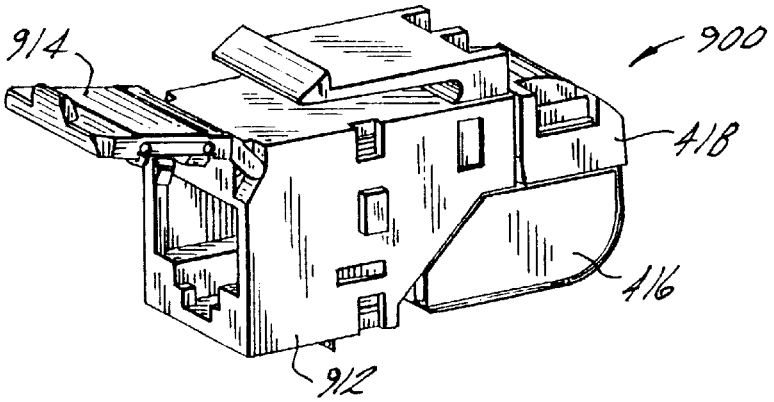
FIG. 26 is a perspective view of a modular outlet in accordance with an embodiment of the present invention.
Figure 27:
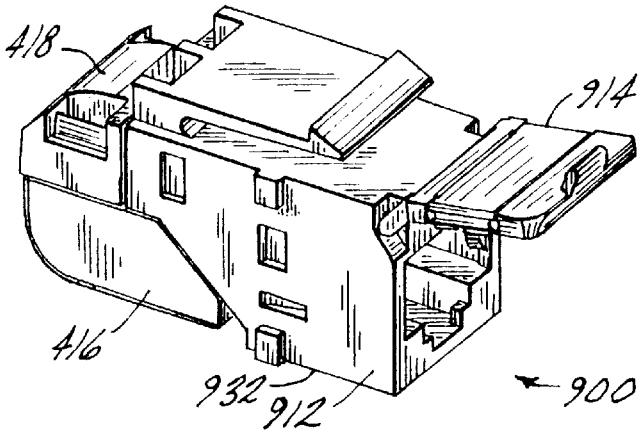
FIG. 27 is another perspective view of the modular outlet of FIG. 26.
Figure 28:
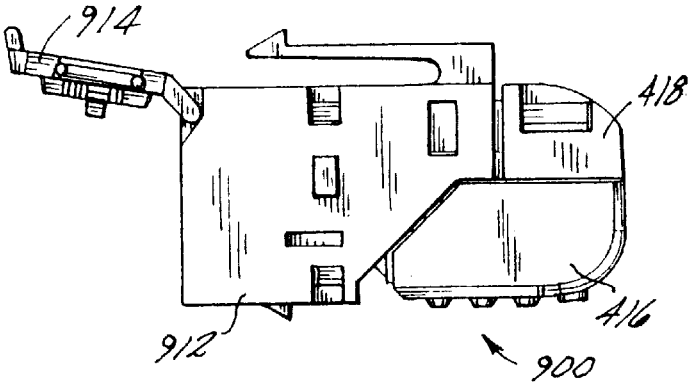
FIG. 28 is a side elevational view of the modular outlet of FIG. 26.

Referring to FIGS. 26–28, a modular outlet in accordance with the present invention is shown generally at 900. Modular outlet 900 is the same as modular outlet 410 of FIGS. 11A–B, except for the connector housing configuration and the addition of a door, as described more fully below.

Figure 29:
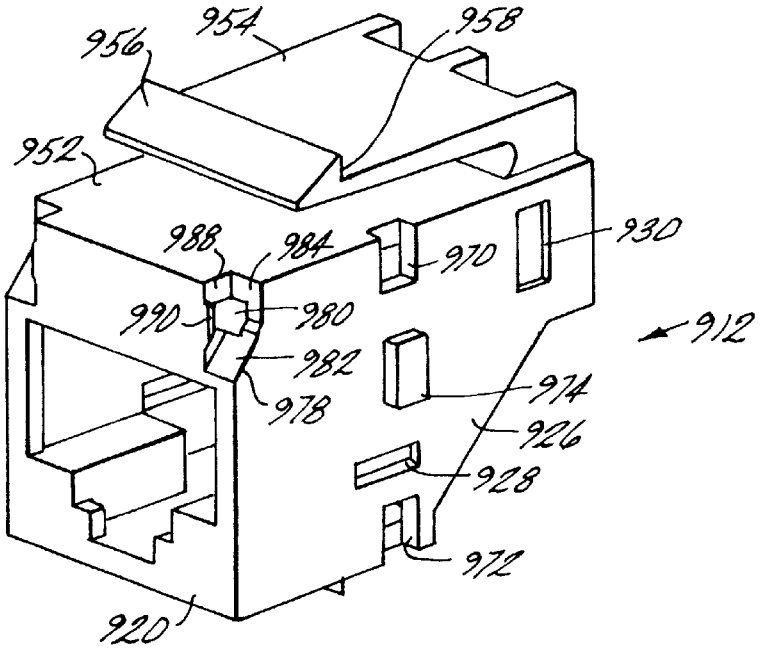
FIG. 29 is a perspective view of the connector housing used in the modular outlet of FIG. 26.
Figure 30:
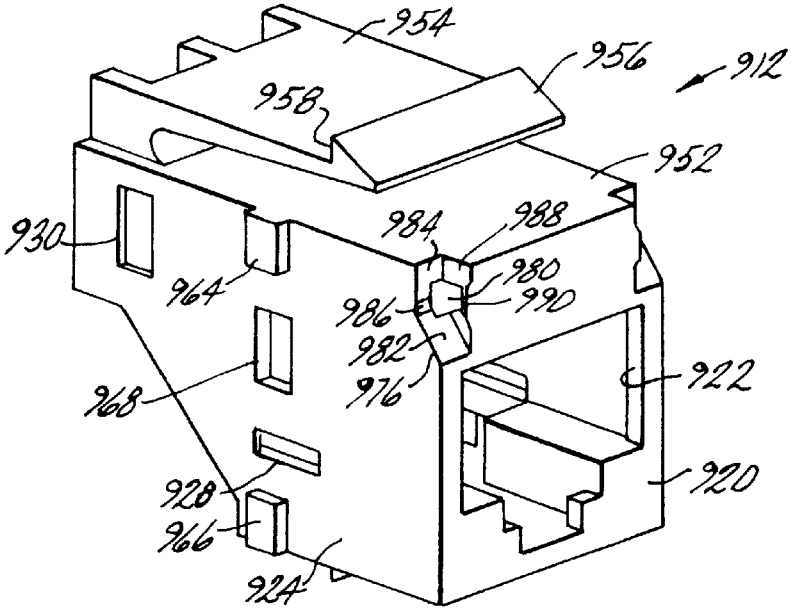
FIG. 30 is another perspective view of the connector housing of FIG. 29.

Referring also to FIGS. 29 and 30, the connector housing 912 comprises a front panel 920 having a standard modular outlet opening 922 therein. A door 914, described more fully hereinbelow, is mounted on housing 912 at opening 922. A pair of side panels 924 and 926 depend rearwardly from panel 920. Each panel 924 and 926 has mounting holes 928 and 930 therein for retention of the contact carrier, as described hereinbefore. A top panel 932 extends rearwardly from panel 920 joining upper edges of panels 924 and 926. Housing 912 further includes a bottom panel 952, which is disposed opposite top panel 932 and which also extends rearwardly from front panel 920. A resilient member 954 depends from the rearward end of panel 952 and then extends approximately parallel thereto to engage a wall panel, plate or the like (e.g., see FIG. 9 for a representative plate) when modular jack 900 is installed in the same.

Connector housing 912 further includes notches 976 and 978 at the corners defined by panels 924, 926 and 952. Each notch 976 and 978 has an opening 980 therein. Each notch 976 and 978 has a sloped lower surface 982 and a rear upright surface 984 with an accurate surface 986 therebetween. Each notch 976 and 978 also has an inside surface 988 with a protrusion 990 extending therefrom.

Figure 31:
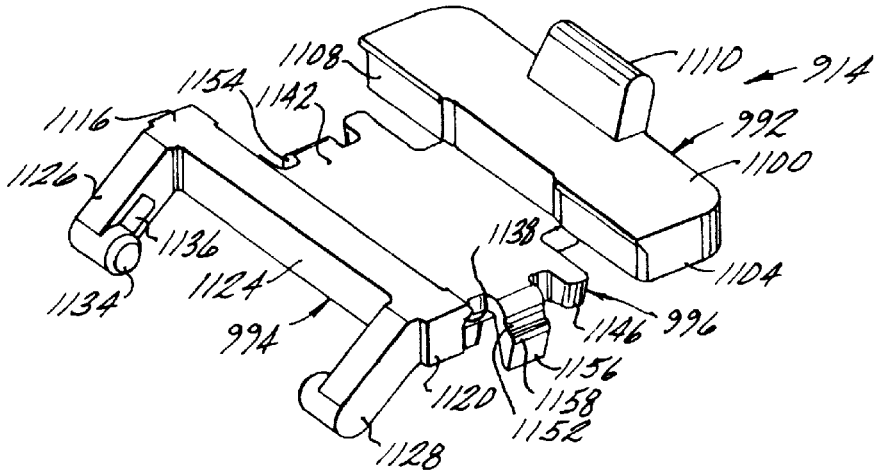
FIG. 31 is a perspective view of the door used in the modular outlet of FIG. 26.
Figure 32:
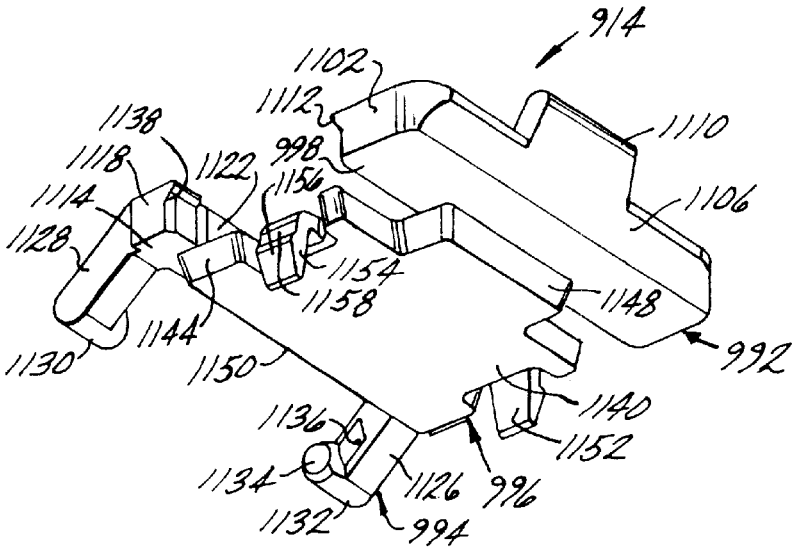
FIG. 32 is another perspective view of the door of FIG. 31.

Referring also to FIGS. 31 and 32, door 914 comprises a first end portion 992, a second end portion 994, and a middle potion 996 disposed therebetween. Portion 992 has a generally rectangular shape comprising opposing ends 998, 1100, opposing sides 1102, 1104 and opposing sides 1106, 1108. A tab 1110 (for use in opening and closing door 914) depends from end 1100 and side 1106. Further, a portion of end 1100 extends beyond side 1108 forming an overhang which defines a retaining edge 1112. Portion 994 comprises a rectangular member having opposing sides 1114, 1116, opposing ends 118, 1120 and opposing sides 1122, 1124. A pair of arms 1126, 1128 depend angularly away from side 1124. Each arm terminates in a corresponding cylindrically shaped member 1130, 1132. A semi-circular protrusion 1134 depends inwardly from the inwardly end of each member 1130 and 1132. Also, adjacent members 1130 and 1132 are protrusions 1136 which depend inwardly from the inwardly surface of each arm 1126 and 1128. Further, a portion of side 116 extends beyond side 1122 forming an overhang which defines a retaining edge 1138.

Portion 996 has a generally rectangular shape comprising opposing ends 1140, 1142, opposing sides 1144, 1146 and opposing sides 1148, 1150. Resistant arms 1152 and 1154 depend downwardly from end 1142 and side 1146. Each arm 1152, 1154 terminates at a ramped surface 1156 defining a retaining edge 1158. End 1142 is connected at opposing sides to corresponding end 998 of portion 992 and side 1114 of portion 994.

A channel defined by side 1108 and edge 1112 of portion 992, surface 1142 of portion 996, and side 1122 and edge 1138 slidingly receives an icon or insert 1160, such as shown in FIGS. 8A–B.

Protrusions 1134 and door 914 are received in openings or recesses 980 of connector housing 912 and members 1130 and 1132 are received in notches 976 and 978, thereby retaining door 914 on housing 912. It is an important feature of the present invention that protrusions 1136 of door 914 bear against surface 988 of the notches (in connector housing 12) and with protrusions 990 on surface 988 causing door 914 to be retained in an open position and closed position, depending on which side of protrusions 990 the protrusions 1136 are disposed. As door 914 is moved between these positions, protrusions 1136 ride over protrusions 990. Further, in the closed position, edges 1158 of arms 1152 and 1154 engage the inside surface of panel 920, to retain door 114 in the closed position when that particular port is not in use.

Figure 33:
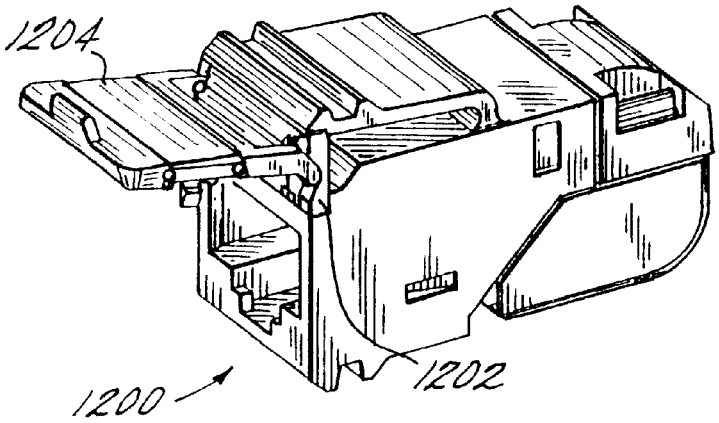
FIG. 33 is a perspective view of a modular outlet in accordance with another embodiment of the present invention.
Figure 34:
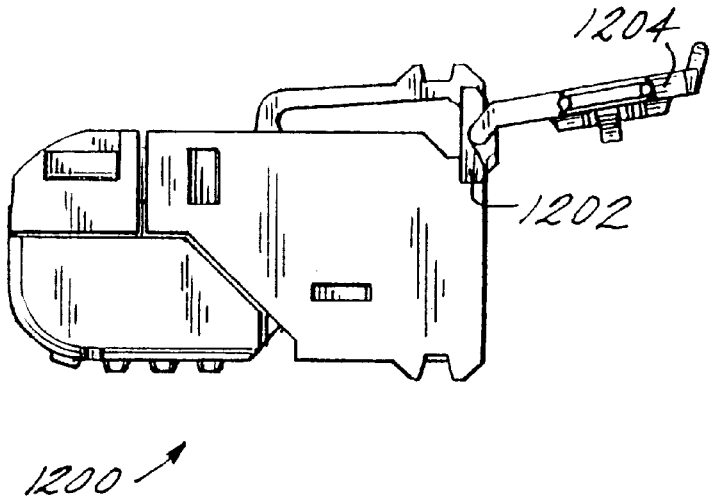
FIG. 34 is a side elevated view of the modular outlet of FIG. 33.
Figure 35:
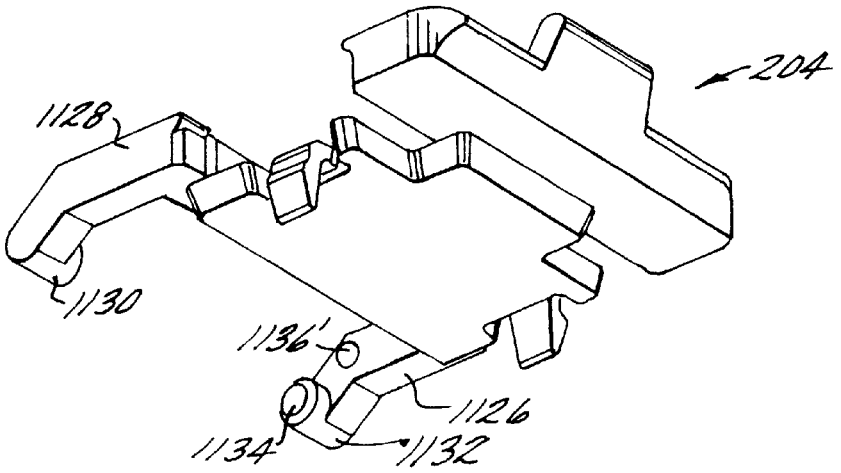
FIG. 35 is a perspective view of the door used in the modular outlet of FIG. 33.
Figure 36:
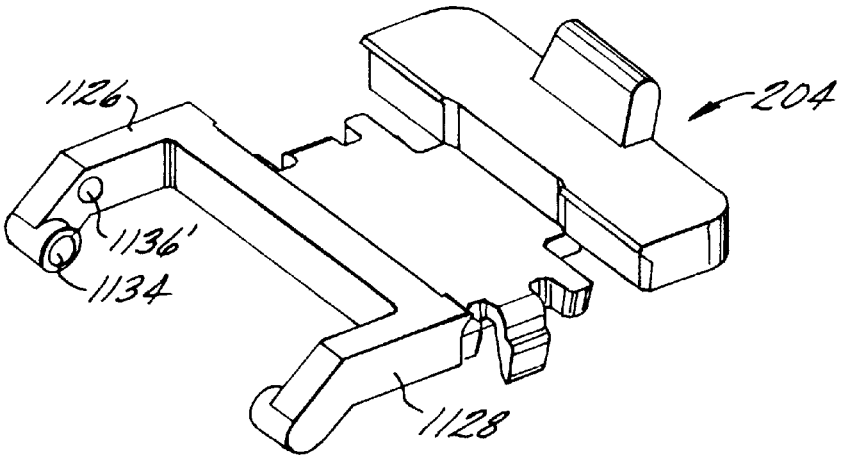
FIG. 36 is another perspective view of the door of FIG. 35.
Figure 37:
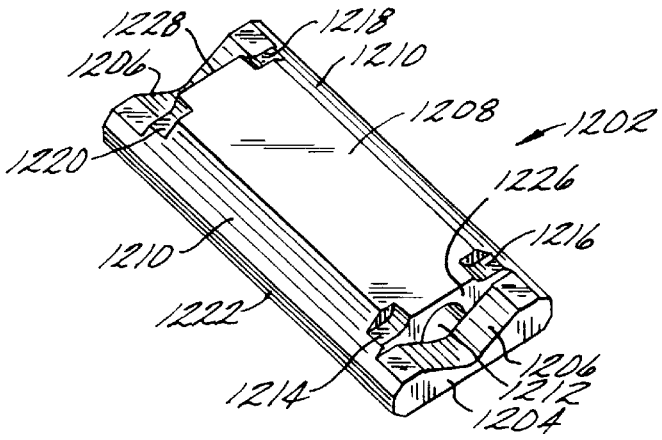
FIG. 37 is a perspective view of the door holder used in the modular outlet of FIG. 33.
Figure 38:
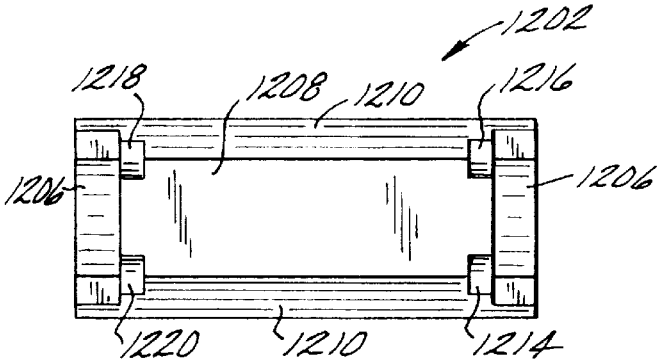
FIG. 38 is a plan view of the door holder of FIG. 37.
Figure 39:
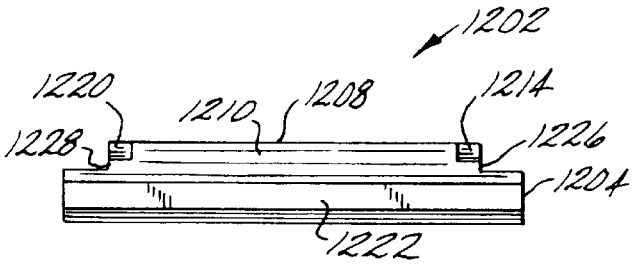
FIG. 39 is a side elevational view of the door holder of FIG. 37.
Figure 40:
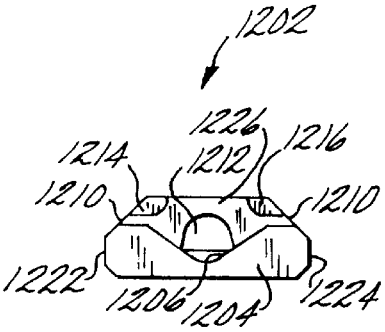
FIG. 40 is an end view of the door holder of FIG. 37.

Referring to FIGS. 33 and 34, a modular outlet in accordance with an alternate embodiment of the present invention is shown generally at 1200. Modular 1200 is the same as modular outlet 810 of FIGS. 24, except a door holder 1202 is inserted in place of the icon and a door 1204 is supported thereon. Door 1202 (FIGS. 35 and 36) is the same as door 914 of FIGS. 31 and 32 except for the shape of protrusions 1136', which are semi-circular in this embodiment. An icon is received in door 1202 in the same manner as described above.

Referring also to FIGS. 37–40, door holder 1202 is generally shown. Door holder 1202 has a generally rectangular shaped base 1204 with a V-shaped notch 1206 formed at opposing ends thereof. Base 1204 has a raised region 1208 depending from one side thereof. The longitudinal sides 1210 of raised region 1208 are sloped downwardly to meet base 1204. Recesses or openings 1212 are formed at opposing ends of raised region 1208, adjacent the vortex of each notch 1206. Corner notches 1214, 1216, 1218 and 1220 are formed at each of the four corners of raised region 1208.

Sides 1222 and 1224 are received in icon grooves 851*a* and *b* (FIG. 25), whereby door holder 1202 is retained in the same fashion the icon is retained in the embodiment of FIG. 25.

Protrusions 1134 of door 1202 are received in openings or recesses 1212 of door holder 1202 and members 1130 and 1132 are received in notches 1206. It is an important feature of the present invention that protrusions 1136' of door 1202 bear against raised portion 1208. Protrusions 1136' of door 1202 when received in notches 1216 and 1218 retain door 1202 in a first (e.g., open) position and in notches 1214 and 1220 retain door 1202 is a second (e.g., closed) position. As door 1202 is moved between these positions, protrusions 1136' ride over the end surfaces 1226 and 1228 of raised portion 1208.

While preferred embodiments have been shown and described, various modifications and substitutions may be made thereto. Accordingly, it is to be understood that the present invention has been described by way of illustrations and not limitation.

What is claimed is:

1. An electrical connector comprising:

a connector housing having an opening for receiving a mating connector;

a door disposed at said opening, said door being movable between an open position where access to said opening is provided and a closed position where access to said opening is precluded, said door being retained in said open position when said door is positioned thereat; and a door holder having said door attached thereto, said door holder including a retaining surface for engaging said door to maintain said door in said open position;

wherein said housing includes a channel and said door holder is removably mounted in said channel.

2. The connector of claim 1 further comprising:

an icon;

wherein one of said door and said door holder receives said icon.

3. The electrical connector of claim 1 wherein said door includes:

an arm depending from said door, said arm having a retaining edge for engaging said connector housing at said opening to retain said door in said closed position.

4. The electrical connector of claim 1 wherein said connector comprises a modular outlet.

5. The electrical connector of claim 1 wherein:

said connector housing includes a channel for receiving said door holder.

6. The electrical connector of claim 1 wherein said connector housing further comprises:

a pair of slots depending from said connector housing, said slots receptive to a panel for mounting said electrical connector to the panel.

7. The electrical connector of claim 6 wherein said connector housing further comprises:

a resilient panel depending from said connector housing, one of said slots depending from said resilient panel.

8. The connector of claim 1 wherein:

a portion of said door holder is positioned in said channel.

9. An electrical connector comprising:

a connector housing having an opening for receiving a mating connector; and a door holder mounted to said connector housing, said housing including a channel and said door holder is removably mounted in said channel;

wherein said door holder further comprises:

a base;

a raised portion depending from said base, said raised portion having openings at opposing ends thereof for pivotable door mounting, said raised portion having a notch therein defining a retained door position; and a door pivotally coupled to said door holder.

10. The connector of claim 9 wherein:

a portion of said door holder is positioned in said channel.

11. An electrical connector comprising:

a connector housing having an opening for receiving a mating connector;

a door holder connected to said housing and positioned adjacent to said opening; and a door attached to said door holder, wherein one of said door and said door holder includes:

a base portion;

a first side wall joining said base portion, a first retaining edge extending from said first side wall; and a second side wall joining said base, a second retaining edge extending from said second side wall;

wherein said base, said first side wall and said second side wall define a channel having at least one open end for retaining an identification element.

12. An electrical connector comprising:

a connector housing having a front face including an opening for receiving a mating connector;

a door holder removably mounted on said housing and positioned adjacent to said opening, said door holder having a width substantially equal to a width of said front face, said housing including a channel and said door holder is removably mounted in said channel; and a door attached to said door holder, said door being movable between an open position where access to said opening is provided and a closed position where access to said opening is precluded;

said door including an arm extending from an interior side of said door, said arm engaging said connector housing to secure said door in said closed position.

13. The connector of claim 12 wherein said arm further includes a retaining edge for engaging said connector housing.

14. The connector of claim 12 wherein:

a portion of said door holder is positioned in said channel.

* * * * *